US005185615A

United States Patent [19]

Koitabashi et al.

[11] Patent Number: 5,185,615

[45] Date of Patent: Feb. 9, 1993

[54] INK JET RECORDING METHOD AND APPARATUS FOR RECOVERING EJECTION AT A PARTICULAR ORIFICE BY EJECTING INK FROM ADJACENT ORIFICES

[75] Inventors: Noribumi Koitabashi; Hiroshi Tajika; Hiromitsu Hirabayashi, all of Yokohama; Masami Ikeda, Tokyo, all of Japan

[73] Assignee: Canon Kabushiki Kaisha, Tokyo, Japan

[21] Appl. No.: 682,675

[22] Filed: Apr. 9, 1991

[30] Foreign Application Priority Data

Apr. 11, 1990 [JP] Japan ..... 95405
Apr. 12, 1990 [JP] Japan ..... 97250

[51] Int. Cl.[5] ..... B41J 2/165; B41J 2/05
[52] U.S. Cl. ..... 346/1.1; 346/140 R
[58] Field of Search ..... 346/1.1, 140 R

[56] References Cited

U.S. PATENT DOCUMENTS

| | | | |
|---|---|---|---|
| 4,313,124 | 1/1982 | Hara . | |
| 4,323,908 | 4/1982 | Lee et al. . | |
| 4,345,262 | 8/1982 | Shirato et al. | 346/140 |
| 4,459,600 | 7/1984 | Sato et al. . | |
| 4,463,359 | 7/1984 | Ayata et al. | 346/1.1 |
| 4,558,333 | 12/1985 | Sugitani et al. . | |
| 4,723,129 | 2/1988 | Endo et al. | 346/1.1 |
| 4,740,796 | 4/1988 | Endo et al. | 346/1.1 |
| 4,779,099 | 10/1988 | Lewis . | |
| 4,965,608 | 10/1990 | Shinohara | 346/1.1 |

FOREIGN PATENT DOCUMENTS

| | | |
|---|---|---|
| 0063637 | 11/1982 | European Pat. Off. . |
| 0259193 | 3/1988 | European Pat. Off. . |
| 0379781 | 8/1990 | European Pat. Off. . |
| 0419180 | 3/1991 | European Pat. Off. . |
| 056847 | 5/1979 | Japan . |
| 74890 | 6/1980 | Japan . |
| 95184 | 7/1980 | Japan . |
| 128558 | 8/1982 | Japan . |
| 123670 | 7/1984 | Japan . |
| 138461 | 8/1984 | Japan . |
| 071260 | 4/1985 | Japan . |
| 63-260456 | 10/1988 | Japan . |
| 1-78846 | 3/1989 | Japan . |
| 1-146751 | 6/1989 | Japan . |
| 194967 | 1/1990 | Japan . |
| 2-192954 | 7/1990 | Japan . |

*Primary Examiner*—Joseph W. Hartary
*Attorney, Agent, or Firm*—Fitzpatrick, Cella, Harper & Scinto

[57] ABSTRACT

An ink jet recording apparatus for performing recording by ejecting ink to a recording medium, has a recording head and head driving unit. To effect ejection recovery, the head driving unit drives selected ejection energy generating elements in the recording head so that ink is ejected from orifices which correspond to the selected ejection energy elements. The selected orifices include at least one orifice adjacent to a particular orifice at which ink ejection recovery is performed, but exclude the particular orifice in an arrangement of the plurality of orifices. This ejection recovery technique efficiently removes bubbles from the particular orifice.

36 Claims, 13 Drawing Sheets

INK JET RECORDING METHOD AND APPARATUS FOR RECOVERING EJECTION AT A PARTICULAR ORIFICE BY EJECTING INK FROM ADJACENT ORIFICES

BACKGROUND OF THE INVENTION

1. Field of the Invention

The present invention relates to an ink jet recording system which is used for outputting hard copies of information such as characters, images or the like in information processing machines such as copying machines, facsimiles, printers, word processors, personal computers and others, and more particularly, to a method and apparatus for recovering ink ejection of a recording head of the ink jet recording system.

2. Description of the Related Art

Ink jet recording apparatuses that perform ink ejection and invalve heat generation are known as types of ink jet recording apparatuses. There are two types of such ink jet apparatuses: one generates thermal energy for ejecting ink, that is, ejects ink by using the thermal energy; and the other incidentally generates heat accompanying the ink ejection. As an example of typical apparatuses of the former type there is known an apparatus that ejects ink on the basis of sudden generation of bubbles accompanying film boiling produced by thermal energy generated by electro-thermal converting elements that operate as ejection energy generating elements. This type of apparatus has advantages as follows: first, a large number of ink orifices and electro-thermal converting elements corresponding thereto can be easily disposed with high density; and second, the ink ejection response to the drive of the electro-thermal converting elements is quick, and hence high speed recording is possible. Thus, this type of apparatuses have been broadly used recently. As the other type of apparatus which incidentally generates heat accompanying the ejection, there is well known as apparatus that uses piezo-electric transducers as ejection energy generating elements. In this system, slight thermal energy is generated when the piezo-electric transducers oscillate for ejecting ink.

In these ink jet recording apparatuses, the thermal energy for or during the ink ejection presents the following problems as already known.

When comparatively high duty recording operations such as recording of visual images or images including solid portions are carried out in such an ink jet recording apparatus, a driving interval of the ejection energy generating elements becomes short. Thus, the next ejection of ink begins before extra heat generated with the ink ejection has been sufficiently dissipated. As a result, heat is stored in ink in ink passages in which ejection energy generating elements are disposed, thereby raising the temperature of the ink. In such a case, fine bubbles remaining in the ink passages will grow owing to the high temperature of the surrounding ink caused by the storing of heat during the recording, or owing to joining of fine bubbles.

The remaining bubbles that grow to a certain size will effect the ejection behavior of ink in the ink passages: they can destabilize the ink ejection by modifying the direction and amount of the ejection. In addition, when such remaining bubbles further grow, they can block the ink passages, thereby hindering the ink ejection. The phenomenon that fine bubbles grow to such sizes as adversely effecting on ink ejection may take place not only by the storing of the heat, but also when the ink jet recording apparatus is left unused for a long time, or when particular orifices are not used for a long time period owing to the arrangement of data to be recorded.

The fine bubbles remaining in the ink passages are produced when the ink therein is raised to a comparatively high temperature by the storing of the heat. In addition, in the apparatus which carries out ink ejection based on abrupt generation of bubbles by using thermal energy, a plurality of fine bubbles that do not serve to for ejection may be generated in conjunction with the bubbles that produce ejection, and may remain in the ink passages. Furthermore, when air is introduced into an ink tube for supplying ink from an ink reservoir to the recording head, the air will form fine bubbles in the ink passages remaining there. The comparatively fine bubbles remaining in the ink passages are partially expelled from the orifices by ink ejection during recording or by an idle ejection operation performed as one of the ejection recovery procedures. Some of the bubbles, however, may grow to a certain size when the heat is stored or when the apparatus is left unused for a long time, and may have an adverse effect on the ink ejection as described above.

To prevent the above-mentioned harmful effects of the remaining bubbles, removal of the remaining bubbles from the ink passages has been conventionally carried out by expelling the ink in the passages as follows: the ink is forcibly sucked through the orifices by using a suction mechanism; or the ink is expelled by exerting pressure on the ink passages with a pressure mechanism.

A comparatively large quantity of ink is expelled by the above-described suction or pressure operation, which can cause the undue consumption of the ink. As a result, the running cost of the recording apparatus increases. Moreover, the suction or pressure carried out during recording will reduce the recording speed of the apparatus because the suction or pressure operation requires comparatively many other operations such as moving the recording head to the capping position in addition to the suction or pressure operation itself.

One characteristic construction of the recording head to be considered in the present invention will be described below in addition to the above-mentioned problem.

The construction is common in recording heads which eject ink by using bubbles generated by the thermal energy. It comprises the following: a substrate that has electro-thermal converting elements that generate thermal energy by applying electric pulses (they are also called "drive pulses" later), electrode wiring for supplying power to the electro-thermal converting elements and so forth formed thereon with the IC fabrication technique; and a top plate that has grooves for forming ink passages in which the electro-thermal converting elements are disposed, and a common liquid chamber for storing ink to be supplied to the ink passages. The substrate and the top plate are joined together by adhesive bonding, thereby constituting the common liquid chamber, ink passages and orifices.

This arrangement of the recording head has some problems concerning the adhesive bonding. First, the adhesives protrude into the ink passages or orifices, which will deviate the shapes of the ink passages or the orifices from the normal shapes, or block the ink passages or orifices. Second, the substrate or the top plate can deform or warp depending on the materials used, which will degrade the adhesive bonding. Third, the substrate and the top plate must be accurately adjusted, which makes complicates the fabricating process of the recording head.

To overcome these problems, Japanese Laid-Open Patent Application No. 2-192954 (or its corresponding European Patent Application Publication No. 0,379,781) propose a recording head which obtains joining force of the substrate and the top plate with a pressure member such as a leaf spring. According to this arrangement, the adhesive can be obviated or limited to a least quantity needed, and hence the deformity of shapes of the ink passages or the orifices owing to the protrusion of the adhesives can be eliminated. Thus, the recording head failure causing the ink ejection failure can be prevented beforehand. Moreover, obviating the adhesives makes the alignment of the substrate and the top plate comparatively easy, thereby simplifying the fabrication process of the recording head.

In the recording head ejecting ink by using thermal energy, the sudden generation of a bubble in the ink, that is, the sudden expansion and the subsequent compression of the bubble, is produced by driving the electro-thermal converting elements. In response to the expansion and compression of the bubble, pressure waves propagate in ink in the ink passages and common liquid chamber. The drive frequency of the electro-thermal converting elements is determined in response to drive data corresponding to characters or images to be recorded, and reaches several kHz in ordinary recording.

When the electro-thermal converting elements are driven for ejecting ink and then the pressure waves of a certain frequency propagate through ink in the passages or the common liquid chamber, periodic forces caused by the pressure waves act on the substrate and the top plate that constitute the ink passages or the chamber.

With regard to this, it has been confirmed that the following phenomenon took place: in the recording head which forms the joining force of the substrate and the top plate with the pressing member such as a leak springs, the oscillation of a certain frequency takes place owing to uneven forces which are caused by the pressure waves and the joining force of the pressing member, and act on the top plate and substrate. Such oscillation, once taking place, produces steady gaps at the rear portions of channel walls each of which separates each of ink passages where the joining force by the pressing member is comparatively small, that is, at the portions behind the electro-thermal converting elements in the ink passages.

Furthermore, the substrate on which the electro-thermal converting elements are disposed has some unevenness because a plurality of layers are overlaid such as a layer for forming the electro-thermal converting elements, a protective layer thereof, or the like. In addition, some portions of the substrate and the top plate can have warped portions. These uneven or wrapped portions can cause thin gaps in the channel walls of the ink passages formed by joining the substrate and the top plate. These gaps will be enlarged by the oscillation mentioned above. Thus, the ink passages will communicate each other through the gaps generated or formed.

SUMMARY OF THE INVENTION

It is therefore an object of the present invention to provide a method for recovering ink ejection of a recording head of an ink jet recording apparatus and an ink jet recording apparatus that can recover the ink ejection by consecutively ejecting ink from orifices connected to the ink passages which include at least the ink passage adjacent to the ink passages that contains bubbles to be expelled, buy which exclude the ink passage that contain bubbles to be expelled, thereby expelling the bubbles in the ink passage.

It is another object of the present invention to provide a method for recovering ink ejection of a recording head of an ink jet recording apparatus and an ink jet recording apparatus that positively utilizes gaps in the channel walls between the ink passages to expel remaining bubbles in the ink passages. In particular, in a recording head in which a substrate and a top plate are joined and fastened with a pressure member such as leaf springs, there is provided a method for recovering ink ejection of a recording head of an ink jet recording apparatus and an ink jet recording apparatus that can recover the ink ejection by consecutively ejecting ink from orifices connected to the ink passages which include at least the ink passages adjacent to ink passages that contain bubbles to be expelled, but which exclude the ink passage that contain bubble to be expelled but which exclude the ink passage that contain bubble to be expelled, thereby drawing bubbles to be expelled into the adjacent ink passages via the gaps, and expelling the bubble in the ink passages with ink ejection.

In a first aspect of the present invention, there is provided a method for performing an ink ejection recovery in an ink jet recording apparatus having a recording head which comprises a plurality of orifices, a plurality of ink passages each of which correspondingly communicates with each of the plurality of orifices and is provided with an ejection energy generating element, and a common liquid reservoir communicating with each of the plurality of ink passages, and performing recording by ejecting ink to a recording medium, the method comprising the step of:

ejecting ink from orifices by driving the ejection energy generating elements of the orifice continuously for predetermined times, the orifices including at least one orifice adjacent to an aimed orifice at which the ink ejection recovery is performed, but excluding the aimed orifice in an arrangement of the plurality of orifices.

In a second aspect of the present invention, there is provided a method for performing an ink ejection recovery in an ink jet recording apparatus having a recording head which comprises a plurality of orifices, a plurality of ink passages each of which correspondingly communicates with each of the plurality of orifices and is provided with an ejection energy generating element, a first substrate and a second substrate for forming the plurality of ink passages by joining the second substrate to the first substrate, and a joining member for press joining the first substrate and the second substrate by means of line pressure applied to the first substrate and/or the second substrate, the method comprising the step of:

ejecting ink from orifices by driving the ejection energy generating elements of the orifices continuously for predetermined times, the orifices including at least one orifice adjacent to an aimed orifice at which the ink ejection recovery is performed, but excluding the aimed orifice in an arrangement of the plurality of orifices.

According to one aspect of the present invention, there is provided an ink jet recording apparatus for performing recording by ejecting ink to a recording medium, comprising:

a recording head having a plurality of orifices, a plurality of ink passages each of which correspondingly communicates with each of the plurality of orifices and is provided with an ejection energy generating element, and a common liquid reservoir communicating with each of the plurality of ink passages; and head driving means for driving the ejection energy generating elements so that ink is ejected from orifices each of which corresponds to each of the ejection energy generating elements, the orifices including at least one orifice adjacent to an aimed orifice at which an ink ejection recovery is performed, but excluding the aimed orifice.

According to a more specific aspect of the invention, there is provided an ink jet recording apparatus for performing recording by ejecting ink to a recording medium, comprising:

a recording head having a plurality of orifices, a plurality of ink passages each of which correspondingly communicates with each of the plurality of orifices and is provided with an ejection energy generating element, a first substrate and a second substrate for forming the plurality of ink passages by joining the second substrate to the first substrate, and a joining member for press joining the first substrate and the second substrate by means of line pressure applied to the first substrate and/or the second substrate; and head driving means for driving the ejection energy generating elements so that ink is ejected from orifices each of which corresponds to each of the ejection energy generating elements, the orifices including at least one orifice adjacent to an aimed orifice at which an ink ejection recovery is performed, but excluding the aimed orifice.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

The invention will now be described with reference to the accompanying drawings.

FIRST EMBODIMENT

Figure 1:
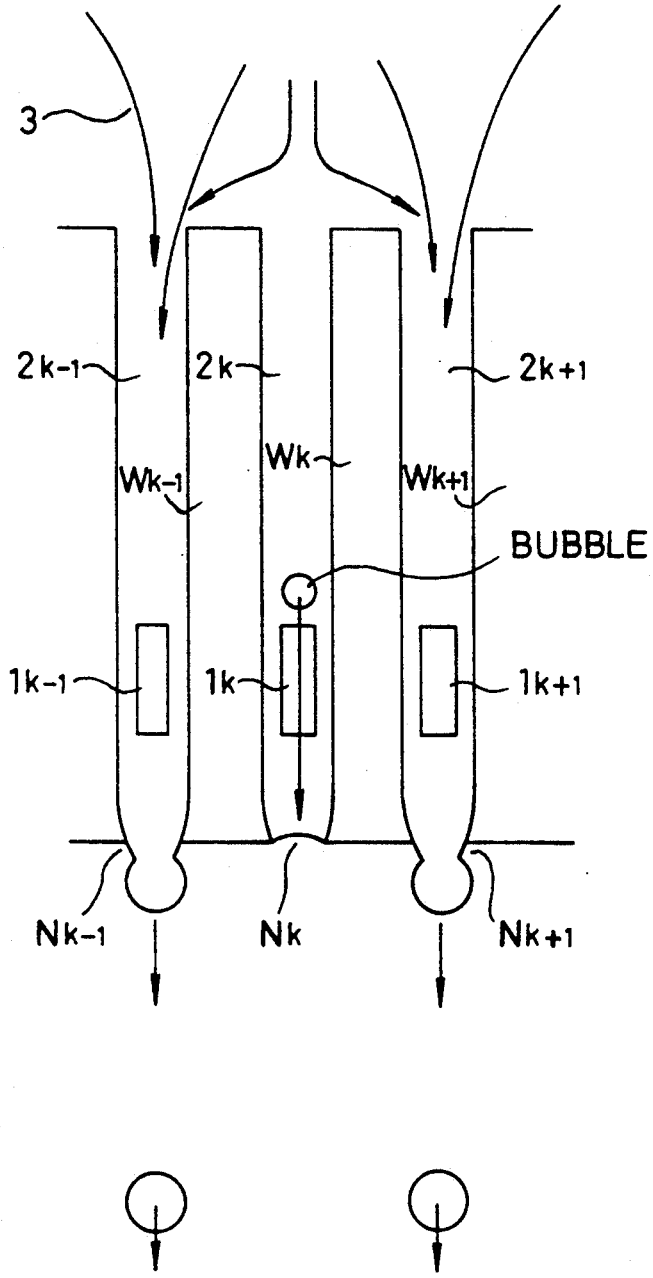
FIG. 1 is a schematic cross sectional view showing a part of a recording head for explaining an ejection recovery procedure of a first embodiment of the present invention.
Figure 2:
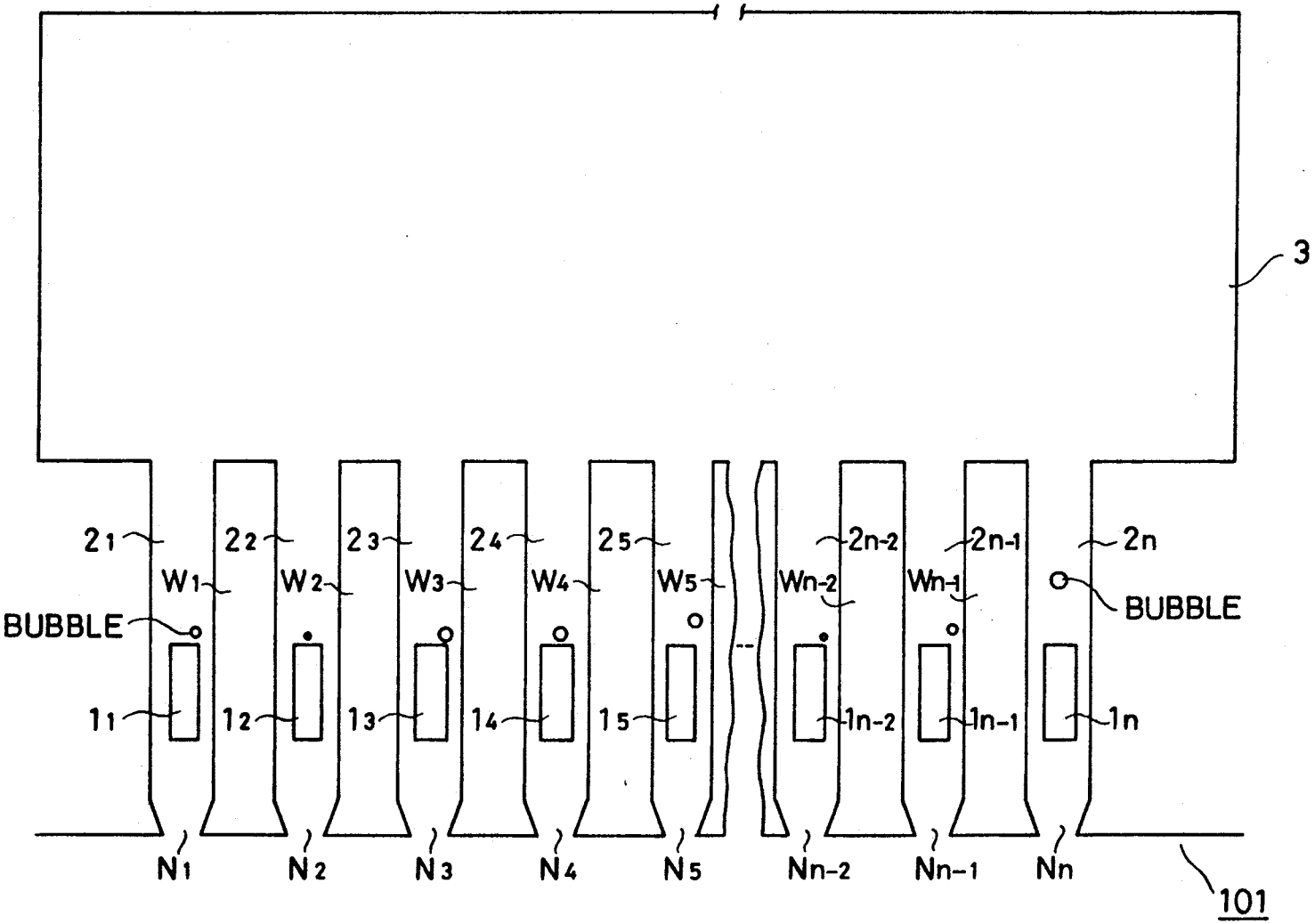
FIG. 2 is a schematic cross sectional view showing an example of a recording head to which an ejection recovery procedure of the present invention is applied.

FIG. 1 is a schematic sectional view showing a part of a recording head for explaining an ejection recovery procedure of a first embodiment of the present invention, and FIG. 2 is a schematic sectional view showing the state of remaining bubbles in a recording head to which a bubble expelling procedure of the present invention is applied.

In FIG. 2, a plurality of electro-thermal converting elements $\mathbf{1}_1$—$\mathbf{1}_n$ which is disposed in ink passages $\mathbf{2}_l$—$\mathbf{2}_n$ respectively, generate thermal energy. In each of ink passages $\mathbf{2}_l$—$\mathbf{2}_n$, a sudden expansion and a subsequent compression of the bubble can be produced at the vicinity of the electro-thermal converting element so that ink is ejected from respective orifices $N_1$—$N_n$. the ink passages $\mathbf{2}_1$—$\mathbf{2}_n$ are supplied with ink from a common liquid chamber 3 storing the ink in accordance with ink ejection.

FIG. 2 shows the state of bubbles remaining in the ink passages $\mathbf{2}_l$—$\mathbf{2}_n$ after two pieces of recording paper have been fully recorded in sequence: bubbles growing to considerable sizes are remaining in the ink passages. Such bubbles which have grown and remain in the ink passages generally decrease their sizes owing to cooling by surrounding ink. Bubbles which have grown beyond a certain size, however, require comparatively long time until disappearing, and they sometimes remain until the next recording is carried out. When recording is carried out in such a state, instability of ejection of ink may take place as previously described, deteriorating the quality of recorded images. Furthermore, when the recording apparatus is left in a comparatively high temperature atmosphere or is left unused for a long time at the state in which bubbles have grown beyond a certain size, the bubbles will grow still greater, thereby blocking the ink passages, which sometimes stops the ejection of ink.

A procedure for expelling bubbles which may have the adverse effect on the ink ejection will be described below. In FIG. 1, a bubble, which has been remaining in a particular ink passages $\mathbf{2}_k$ at the center of the figure, can expelled from the orifice $N_k$ as follows: first, 10–100 times of ejections of ink from the adjacent orifice $N_{k-1}$ are carried out by applying electric pulses to the electro-thermal converting element $\mathbf{1}_{k-1}$; second, similar times of ejections of ink from the other adjacent orifice $N_{k+1}$ are carried out by applying electric pulses to the electro-thermal converting elements $l_{k+1}$. These pulses take place at a predetermined frequency, and each of the m has the same energy as that of the pulses used in the recording operation.

Alternatively, ejections from the orifices $N_{k-1}$ and $N_{k+1}$ similar to those of the above followed by further 10–100 times of ejections from the orifice $N_{k-1}$ can achieve a more effective expulsion of the bubble.

Furthermore, the ejection operation described above in which ejections from the orifices $N_{k-1}$ and $N_{k+1}$ are sequentially performed can be repeated a plurality of times.

In addition, to ensure the expulsion of bubbles, the ink ejection from the adjacent orifices as described above may be followed by the ink ejection from the orifice from which the bubbles must be expelled. In this case, the operation is carried out as follows: first, bubbles remaining in an aimed or particular ink passage are usually expelled therefrom by the ink ejection from the adjacent ink orifices; and second, a comparatively large bubble, which may remain near an aimed orifice owing to meniscus associated with the bubble, is expelled with ink ejected from the aimed orifice connected to the aimed ink passage by driving the electro-thermal converting element thereof.

In these cases, it is not preferable that the electro-thermal converting elements $1_{k-1}$ and $1_{k+1}$ are driven at the same frequency as that of the recording operation because at this frequency the temperature rise by the stored heat so that bubbles will grow in the liquid passages $2_{k-1}$ and $2_{k+1}$ containing these electro-thermal converting elements. To prevent this, it is preferable that ink ejections from the adjacent orifices $N_{k-1}$ and $N_{k+1}$ are performed at a lower drive frequency than that of the recording operation so that the thermal diffusion takes place during the intervals between the pulses and hence the bubbles do not grow. In this example, the drive frequency of the recording operation is 4 kHz and that of the bubble expulsion is lower than 2 kHz and preferably below 1 kHz.

Furthermore, the drive frequency can be altered: for example, when the ejection operation in which ejections from the orifices $N_{k-1}$ and $N_{k+1}$ are sequentially performed is repeated a plurality of times, the drive frequency can be decreased as the repetition time increases. By using such a technique, remaining bubbles of various sizes can be effectively expelled in accordance with their sizes because it is supposed that comparatively large remaining bubbles are effectively expelled by driving with relatively high frequencies, and comparatively small remaining bubbles are effectively expelled by driving with relatively low frequencies. Moreover by gradually reducing the frequencies, the temperature rising of the recording head associated with the ink ejection of the ejection recovery procedure can be prevented. Incidentally, the drive frequencies can be changed in accordance with the time of non recording, recording duty, or indices indicating the sizes of bubbles. The ejection operation in which the drive frequencies are changed is effective for all the ink ejections in the ejection recovery of the present embodiment.

In the above bubble expelling operation, bubbles are expelled by sequentially ejecting ink from both the adjacent orifices. The expulsion of the bubble, however, can be accomplished by expelling ink from one of the two adjacent orifices. A simultaneous ink ejection from both the adjacent orifices, however, are more effective, and can shorten the time required for the expulsion of bubbles.

A hypothetical principles of the bubble expulsion as described above will be described with reference to FIG. 1. In FIG. 1, the simultaneous ink ejections are carried out from the orifices $N_{k-1}$ and $N_{k+1}$ adjacent to the orifice $N_k$ from which a bubble must be expelled. The principle of the bubble expulsion is thought to be as follows: Continuous ink ejections from the orifices $N_{k-1}$ and $N_{k+1}$ generate ink currents from the common liquid chamber 3 to the ink passages $2_{k-1}$ and $2_{k+1}$ as shown by arrows in FIG. 1. The ink currents will increase the ink pressure near the boundaries between the ink passage $2_k$ and the common liquid chamber 3. This will produce in the ink passage $2_k$ a pressure slope which is higher on the side of the common liquid chamber and is lower on the side of the orifice $N_k$. The pressure slope will generate force (a kind of buoyant force in its broad sense) toward the orifice $N_k$, which acts on the bubble remaining in the ink passage $2_k$, thereby moving the bubble to the orifice $N_k$.

As an alternative hypothetical principle, the bubble expulsion is supposed to take place as follows: When the bubbles for ink ejection are generated in the adjacent ink passages $2_{k-1}$ and $2_{k+1}$, the sudden expansion of the bubbles produces pressure waves in the ink pressure $2_{k-1}$ and $2_{k+1}$, and the pressure waves propagate toward the orifices $N_{k-1}$ and $N_{k+1}$ as well as toward the common liquid chamber 3. The pressure waves propagate to the common liquid chamber 3 where they make reflection and interference, and subsequently travel to other ink passages. Although the pressure waves are little attenuated during travelling in the ink passages where they are generated, they are weakened in proportion to the square of distances from the ink passages when they propagate in the common liquid chamber. For this reason it is supposed that the pressure waves produced in the ink passages $2_{k-1}$ and $2_{k+1}$ propagate to the adjacent ink passage $2_k$ with a considerable intensity, and that the pressure waves expel the remaining bubbles when the waves propagate in the ink passages $2_k$ toward the orifice $N_k$. Alternatively, it is assumed that the propagation of the pressure waves causes a pressure slope in the ink passages as in the principle described before, and this pressure slope expels the remaining bubbles. Still alternatively, it may be supposed that the bubble expulsion by the pressure waves operates in conjunction with the bubble expulsion by the pressure slope caused by the ink flow as described above, thereby expelling the remaining bubbles.

As a third hypothetical principle, it is supposed that the remaining bubbles are expelled by the ink flow toward the orifice $N_k$, which flow is produced by the pressure inclination in the ink passage $2_k$.

In the ejection recovery procedure described above, the bubble expulsion is carried out by ejecting ink from only the adjacent orifices. Ejection of ink, however, may be performed from other orifices at the same time: for example, in FIG. 2, simultaneous ink ejections from the orifices $N_1$ and $N_2$ and orifices $N_4$ and $N_5$ may be carried out to expel a bubble in the ink passages $2_3$. The ink ejections not only from the adjacent orifices but also from other orifices will improve the effect of bubble expulsion.

Furthermore, another ejection recovery procedure using the bubble expelling procedure described above is performed as follows. When the recording apparatus is left unoperated for a long time, ink will vaporize from the orifices, thereby increasing the viscosity of the ink in the ink passages and the remaining bubbles grow. This will hinder the normal ejection of ink, and sometimes causes orifice clogging. In such cases the following steps are taken: first, high duty ink ejections, that is, driving the electro-thermal converting elements with high frequency are carried out to elevate the temperature in the ink passages so as to lower the viscosity of the ink therein, thus discharging the highly concentrated ink; after that, the ink ejections with frequency lower that above frequency are carried out. Such ink ejection operation is performed in such manner that alternate continuous ejections from the odd number orifices and from the even number orifices in a series of orifices are carried out to further expel the high concentration ink in the ink passages, and at the same time to expel the remaining bubbles therein. Thus, the normal ejection of ink becomes possible, and hence the recording apparatus which has been left unoperated for a long time can provide stable, high quality images.

Further ejection recovery procedure will now be described.

Figure 10:
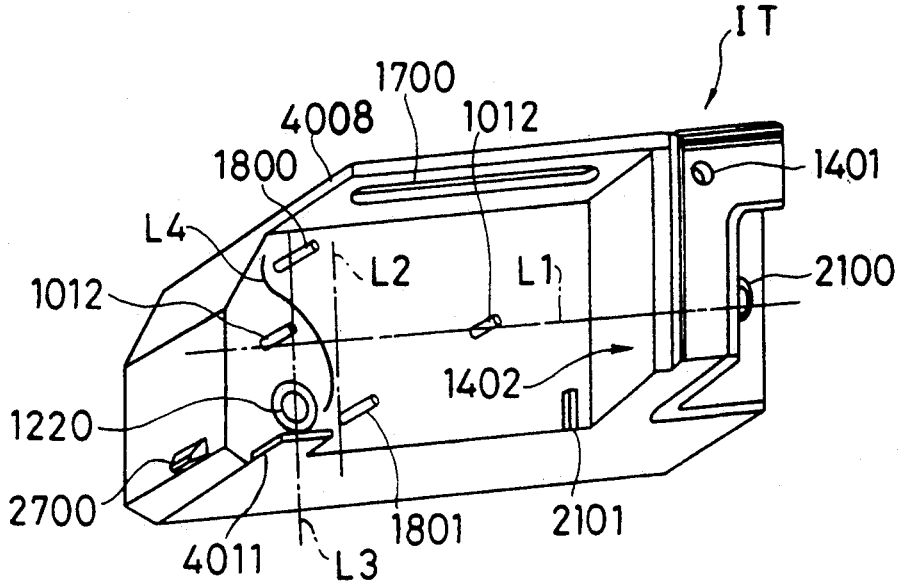
FIG. 10 is a perspective view showing the details of a ink tank unit of the cartridge shown in FIG. 8.

In FIG. 2, 10–100 times of continuous ejections from each respective orifices $N_l$–$N_n$ of the head are carried out in sequence. This method has an advantage that the checking that if each orifice normally ejects ink can be achieved simultaneously during the ink ejection for expelling the remaining bubbles in each orifice.

In addition, this method is effective for expelling bubbles; for example, let us suppose that the head has 64 orifices; in this case, by sequential ejections from all the orifices 1–64, followed by several times repetitions of the sequential ejections, the remaining bubbles are expelled from each orifice. During this operation, it will be very effective in expelling bubbles if the intervals of continuous ejections from each orifice are changed in such a fashion that the intervals are set longer at first and then are gradually shortened as the repetitions proceed.

The ejection recovery procedures described above are also effective as the idle ejection which is carried out when continuous high duty recording operations are performed and hence heat is stored in the each ink passage. Furthermore, the ejection recovery procedures, when applied to the recording apparatuses of printers, facsimiles or the like, can be performed during waiting times for recording commands, or during data transmission, which can prevent a decline of recording speed of the recording apparatus.

When the ejection recovery procedures are applied to copying machines, they can be achieved after a high duty recording operation, or during intervals between recording operations of respective pieces of recording paper. Thus, continuous, high quality recording of images can be achieved without other procedures such as suction or the like.

Figure 3:
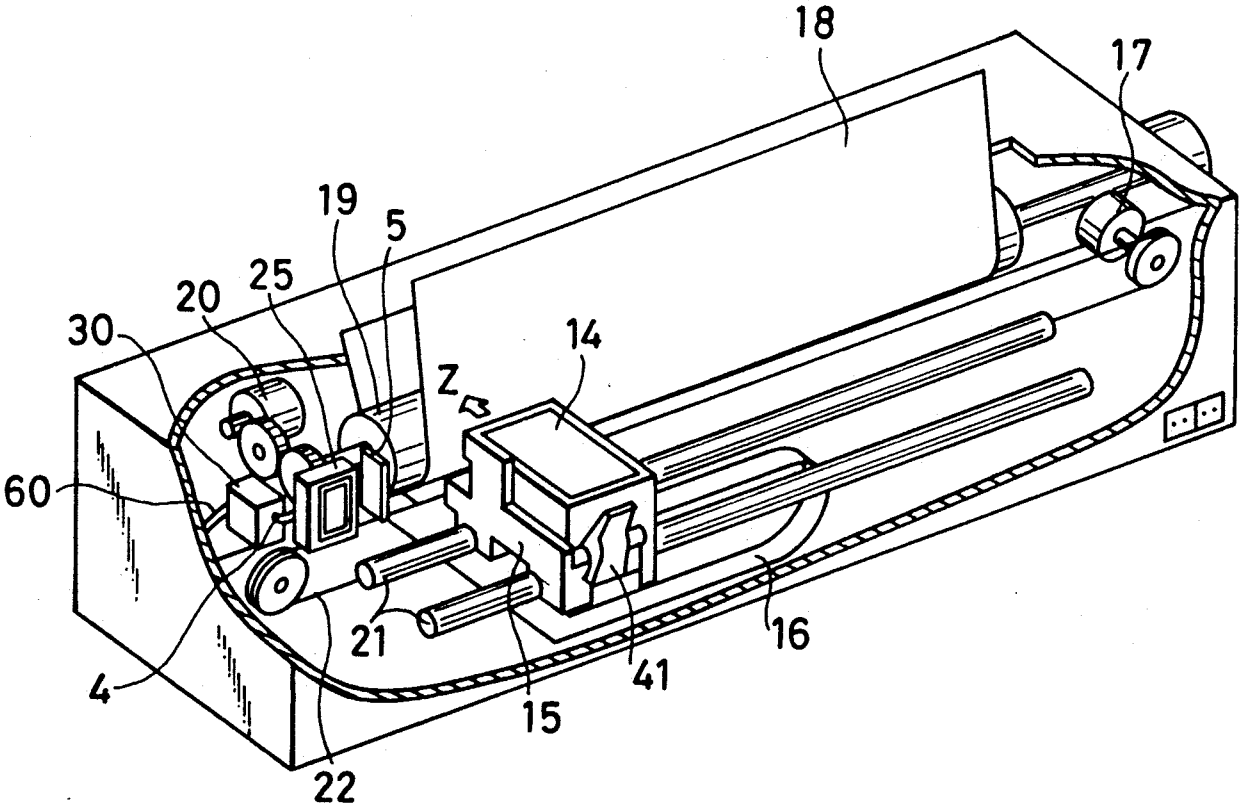
FIG. 3 is a schematic perspective view showing an example of an ink jet recording apparatus in which the ejection recovery procedure of the present invention can be implemented.

FIG. 3 is a perspective view showing an arrangement of an example of an ink jet recording apparatus to which the ejection recovery procedures can be applied.

In FIG. 3, reference numeral 14 designates a recording head cartridge having a recording head chip and an ink tank which are constructed into one body. Here, the recording head chip has orifices for ejecting ink, and electro-thermal converting elements as energy generating elements corresponding to the orifices. The ink tank functions as an ink supply. The head cartridge 14 is fixed on a carriage 15 by means of a pressing member (fixing lever) 41, and these components 14 and 15 can move to and fro in the longitudinal directions along shafts 21. The ink ejected from the orifices of the recording head chip reaches a recording paper 18 as a recording medium which is regulated by a platen roller 19 disposed against the orifices via slight space, thereby to form an image on the recording paper 18.

The electro-thermal converting elements disposed in the recording head chip are supplied from a data supplying source with ejection signals corresponding to image data via a cable 16 and terminals connected thereto. Only one head cartridge 14 is provided in this example.

In FIG. 3, reference numeral 17 designates a carriage motor for driving the carriage 15 along the shafts 21, 22, a wire for transmitting the drive force of the motor 17 to the carriage 15, 20, a feed motor for conveying the recording paper 18 in conjunction with the platen roller 19.

Reference numeral 25 denotes a capping member which is disposed at a position corresponding to the home position of the carriage 15, and which can cover an orifice-disposed face of the heat chip on which the orifices are disposed. The capping member 25 prevents drying or caking involved in the drying of ink near the orifices. To the capping member 25 is connected via a tube 4 a pump 30 for eliminating an ejection failure. When the pump 30 is driven for eliminating the ejection failure, ink is sucked from the orifices by the sucking force caused by the pump 30. The ejection recovery procedure by sucking as a different mode from the bubble expelling procedure is carried out for removing high viscosity or hardened ink near the orifices. Such high viscosity or hardened ink appears when non-recording state continues for a long time or when particular orifices are not used for a long time owing to the arrangement of printed images. The capping member 25 is provided with a member for receiving ink ejected for a long time recovery procedures.

Adjacent to the capping member 25, a blade 5 is disposed in such a manner that it can project toward the region where the recording head can move. The blade 5 is used to wipe the orifice disposed face after the ejection recovery procedure or the like so that wet or paper particulate contaminants are removed therefrom.

Figure 4:
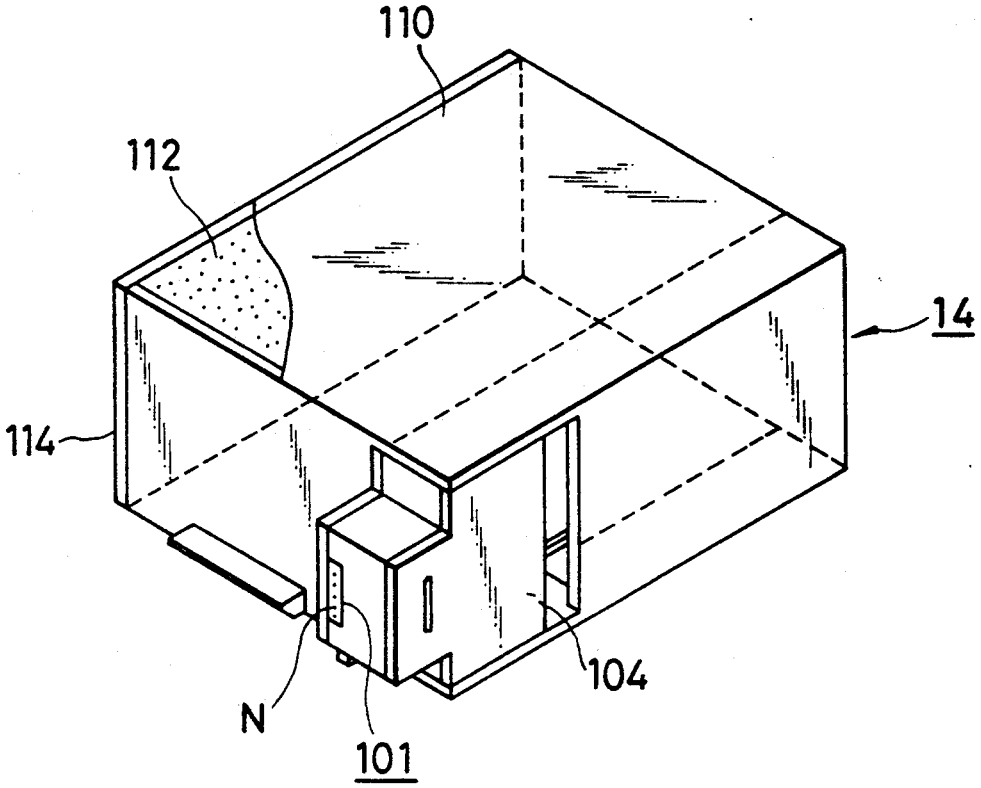
FIG. 4 is a perspective view showing the details of a recording head cartridge shown in FIG. 3.

FIG. 4 is a perspective view of the recording head cartridge 14 of the embodiment as shown in FIG. 3. The head cartridge 14 is a detachable type incorporating an ink tank 110 that functions as the ink supply, and a recording head chip 101. The recording head chip 101 is exchanged for new on in company with the exchange of the head cartridge 14 when ink in the ink tank is spent.

The recording head chip 101 comprises the following: a plurality of orifices N aligned on a surface opposite to the recording medium; a plurality of ink passages (not shown) each of which extends inside each of the orifices respectively electro-thermal converting elements (not shown) each of which is disposed in each of the ink passages; and a common liquid chamber (not shown) communicating to the respective ink passages. A supply reservoir portion 104 functions as a sub-reservoir that receives ink from the ink tank 110 and guides the ink into the common liquid chamber in the recording head chip 101.

The ink reservoir 110 contains a ink absorber 112, which is made of porous material or of fibers or the like, for impregnating ink. The ink tank 110 has a lid 114.

Figure 5:
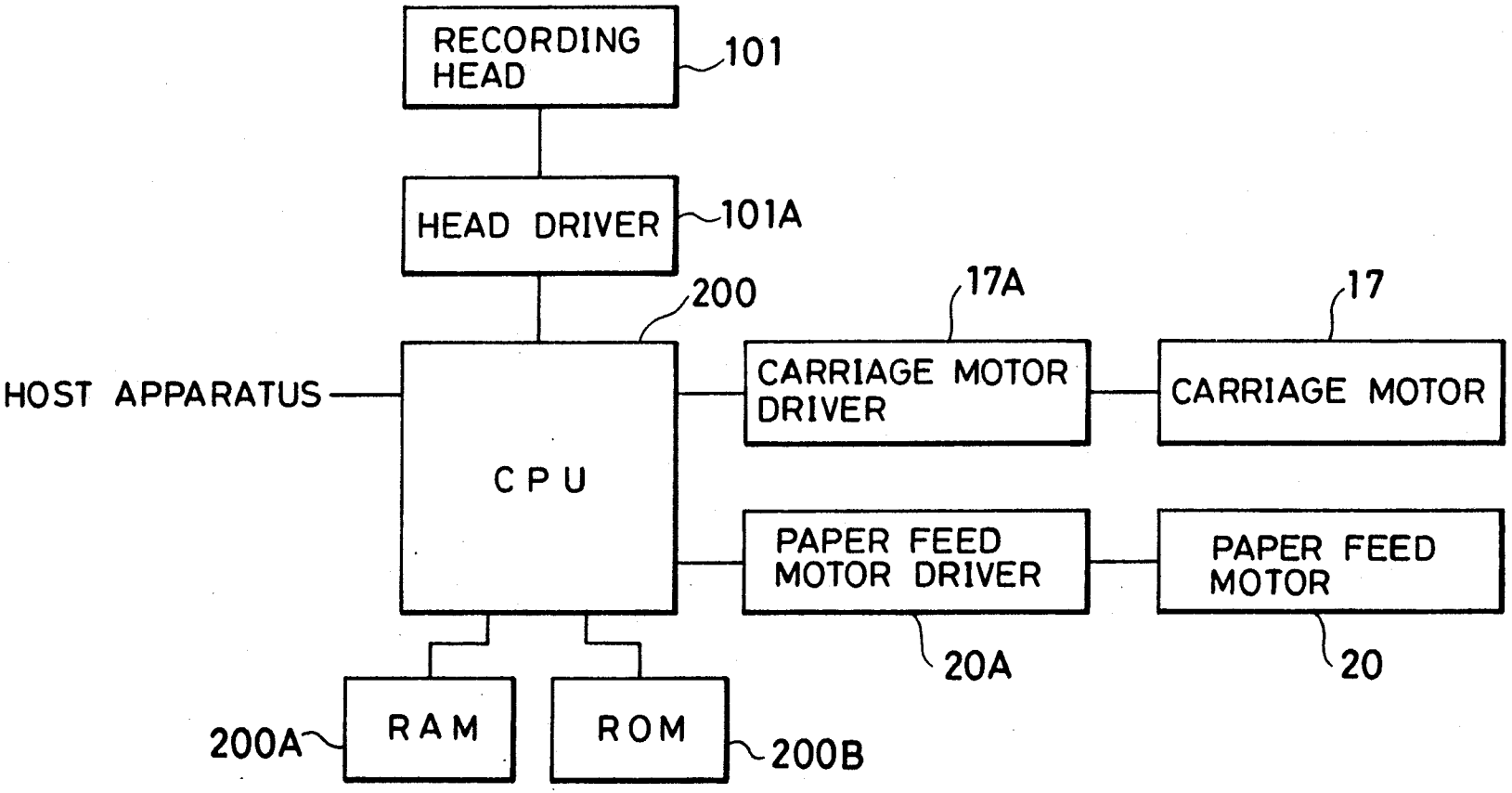
FIG. 5 is a block diagram showing an arrangement of a controlling portion of the apparatus shown in FIG. 3.

FIG. 5 is a block diagram showing an arrangement of a control portion of the apparatus as shown in FIG. 3. The control portion controls the ejection recovery procedures described above.

In FIG. 5, a CPU 200 processes various signals for controlling the apparatus. The CPU 200 is connected to an RAM 200A which is used as work areas or for other purposes during the processing, and to an ROM 200B that stores drive data, processing procedures, etc., for controlling the ejection recovery procedures described above. During the ejection recovery procedure, the CPU 200 supplies a head driver 101A with the following data according to the processing procedures stored in the ROM 200B: selection data for selecting orifices to perform ejection; pulse width data for determining the width of the electric pulses; and drive frequency data for determining the drive frequency of the electro-thermal converting elements.

In addition, the CPU 200 supplies necessary data to a carriage motor driver 17A and a paper feed motor driver 20A to drive a carriage motor 17 and a paper feed motor 20, thereby controlling the moving of the carriage 15 and the feeding of the recording paper 18.

Figure 6:
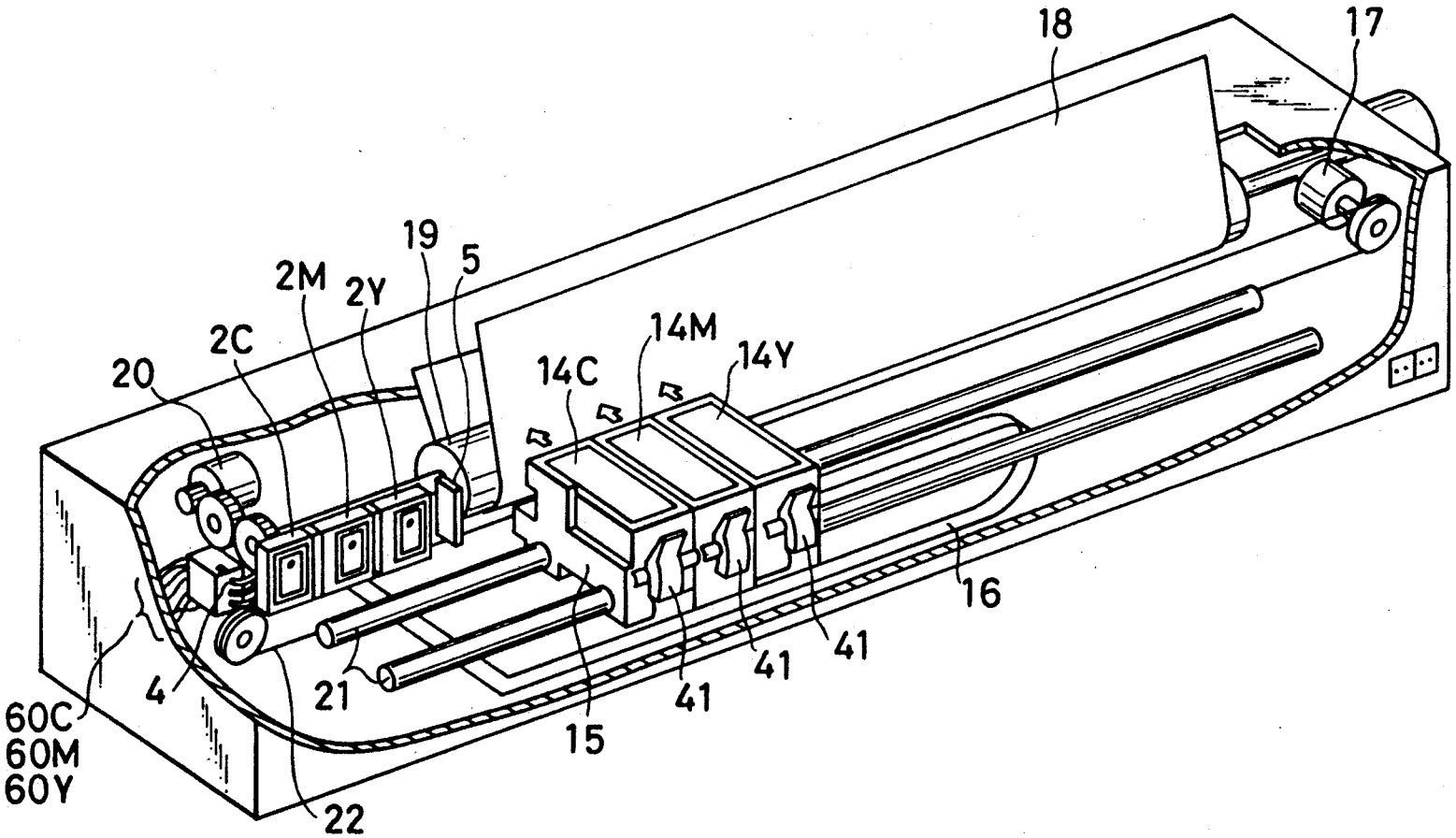
FIG. 6 is a schematic perspective view showing another example of an ink jet recording apparatus in which the ejection recovery procedure of the present invention can be implemented.

FIG. 6 is a perspective view showing an example of an ink jet recording apparatus that can achieve a full-color recording. With such an apparatus provided with a plurality of recording heads, the ejection recovery procedures of the present invention can reduce the number of ink suction procedures for ejection recovery. This makes it possible to save ink which is otherwise spent by the suction procedures.

SECOND EMBODIMENT

A second embodiment of the present invention relates to an ink expulsion procedure which positively utilizes the gaps in the channel walls forming the ink passages of the recording head. When a common recording head is built, the substrate and the top plate are joined by adhesive bonding so that the gaps are not procedure in the channel walls between the ink passages. In this case, placing of adhesives and the arrangement for producing joint force must be carefully carried out. In contrast with this, in a recording apparatus that joints the substrate and the top plate by means of plate springs to simplify the construction as mentioned above, gaps may be produced in channel walls separating the ink passages. The second embodiment positively utilizes the gaps to eliminate remaining bubbles.

Figure 7:
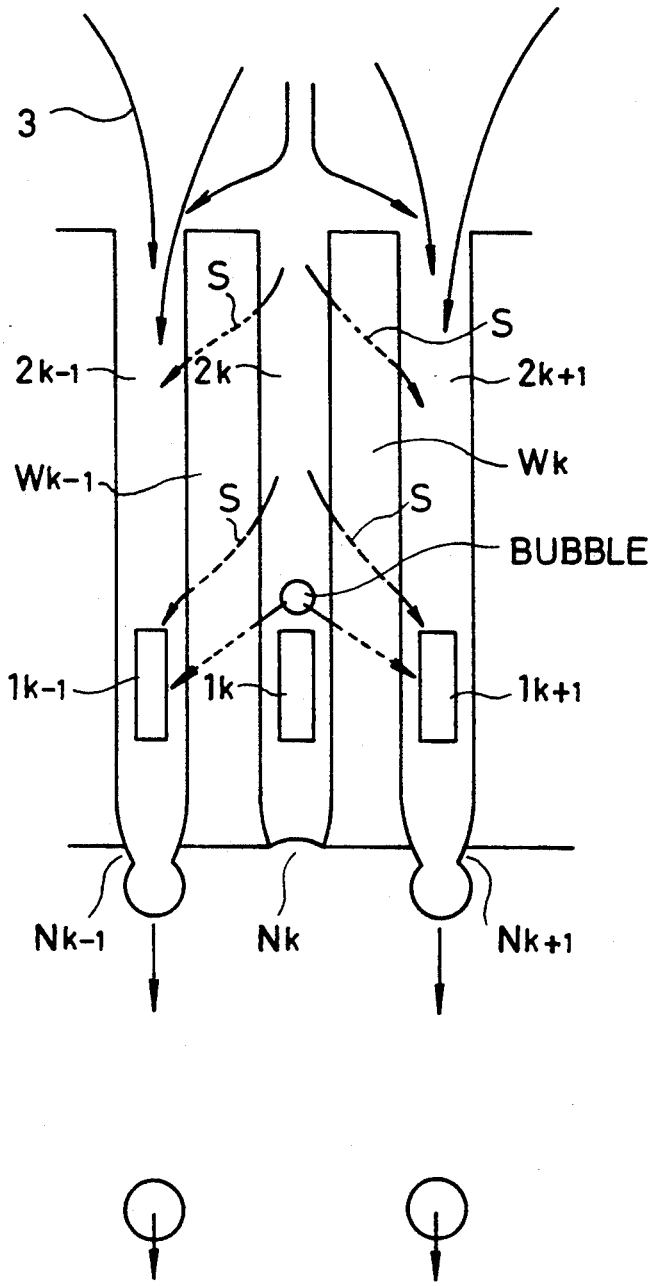
FIG. 7 is a schematic cross sectional view showing a part of a recording head for explaining an ejection recovery procedure of a second embodiment of the present invention.

FIG. 7 is a schematic sectional view showing a part of a recording head for explaining a hypothetical principle of the second embodiment of the present invention.

In FIG. 7, a bubble, which has been remaining in the ink passage $2_k$ at the center of the figure and may have adverse effect to the ink ejection, can be expelled from the orifice $Nk_{-1}$ or $Nk_{+1}$ as follows: first, 10–100 time of ejections of ink from the adjacent orifice $N_{k-1}$ are carried out by applying electric pulses to the electro-thermal converting element $1_{k-1}$; second, similar times of ejections of ink from the other adjacent orifice $N_{k+1}$ are carried out by applying electric pulses to the electro-thermal converting element $1_{k+1}$. These pulses take place at a predetermined frequency, and each of the m has the same energy as that of the pulses used in the recording operation.

Alternatively, ejections from the orifices $N_{k-1}$ and $N_{k+1}$ similar to those of the above followed by further 10–100 times of ejections from the orifice $Nk_{-1}$ can achieve a more effective discharge of the bubble.

In this case, the electro-thermal converting elements $1_{k-1}$ and $1_{k+1}$ are driven at same frequency as that of the first embodiment.

In the above bubble expelling operation, bubbles are expelled by sequentially ejecting ink from both the adjacent orifices. The expulsion of the bubble, however, can be accomplished by expelling ink from one of the two adjacent orifices.

Now, one conceivable principle underlying the phenomenon of the expulsion of bubbles as described above will be explained referring to FIG. 7. FIG. 7 is a view illustrating the case where ink is ejected simultaneously from both of orifices $N_{k-1}$ and $N_{k+1}$ which are adjacent to the orifice $N_k$ connecting to an ink passages 2k from which bubbles must be expelled. In this case, the phenomenon is considered to be based on the following principle. Ink refill resulting from the continuous ink ejection from a respective one of the ejection outlets $N_{k-1}$ and $N_{k+1}$ provided on both sides of the ink passages 2k causes ink streams flowing from the common liquid chambers 3 to ink passages $2_{k-1}$ and $2_{k+1}$ as arrowed in FIG. 7. These ink streams give rise to further ink streams as shown by arrow S through gaps which occur at the channel walls $W_{k-1}$ and $W_k$ due to pressure waves or the like when the ink is being ejected. The bubbles staying in the ink passages $2_k$ are sucked into the ink passages $2_{k-1}$ or $2_{k+1}$ through the channel walls $W_{k-1}$ or $W_k$ due to the ink streams S flowing through the gaps, and at the same time, expelled from the ejection outlets $N_{k-1}$ or $N_{k+1}$ concurrently along with the ink ejection through the ink passages.

The ejection from the adjacent ink passages performed only once rarely allows bubbles to be sucked. A plurality of continuous ejection operations allow bubbles to be gradually sucked through the gaps. It is considered that initial positions of bubbles and extent of the gaps are factors that determine which one of the adjacent ink passages sucks the bubbles in the case where the ejection operations are simultaneously performed from both of the adjacent ink passages.

In the bubble expelling procedure in accordance with this embodiment, the number of the ejection outlet for ejection and a period when the continuous ejection operations are repeated are set in a like manner as explained with reference to the first embodiment. Further, this embodiment attains substantially the same results as those of the first embodiment.

Next, the following explanations relate to a recording head which is suitable for performing the bubble expelling procedure according to the second embodiment of the present invention as described above, and one example of an ink jet recording apparatus employing the recording head.

This recording head has a simple structure, leading to relatively low manufacturing cost. A further advantage is that the recording head is capable of reliably discharging staying bubbles out of ink passages with effectiveness by utilizing mutual interference between the adjacent ink passages as is generally thought to be disadvantageous. More specifically, the recording head may be of a structure such that two members of the top plate and the substrate are joined together by pressure (or also the two members maybe joined together by partially applying an adhesive to some portions thereof), the top plate having grooves for forming the ink passages and the common liquid chamber, the substrate having the electro-thermal converting elements formed therein. Here, the grooves forming ink passages or the like and the electro-thermal converting elements may be formed on either of the ceiling plate or the substrate.

Now, one embodiment will be described below having a structure which permits the force produced by pressure as described above to uniformly exercise corresponding regions covering the electro-thermal converting elements and the orifices of the recording head, particularly areas extremely near to the orifices. In order to achieve the press joining of the members by applying the uniform force as described above, line pressure is utilized. A few examples of the recording head having such structure as described above will be shown below.

A first example of the recording head has orifices for ejecting ink, ink passages communicating with the orifices, and an ejection energy generating element which are disposed on predetermined positions of the ink passages, for example an electro-thermal converting elements, for generating energy for ejecting ink, in which a first and second substrates where the ink passages and the orifices are formed are press joined by a line pressure pressing member for generating line pressure.

A second example of the recording head has a first substrate having ejection energy generating elements for generating energy for ejecting ink from orifices, a second substrate having recesses and projections for forming ink passages communicating with the orifices when the second substrate is joined with the first substrate and a leaf spring member for mechanically joining the first substrate with the second substrate, in which the first and second substrates are press joined by line pressure produced by an end portion of a bent projection of the leaf spring.

A third example of the recording head comprises a first substrate having ejection energy generating element for generating energy for ejecting ink from orifices, a second substrate having an orifice plate having the orifices, a front plate member being formed integral to the orifice plate and having a portion projecting outwardly, and recesses and projections which are formed integral thereto and form ink passages communicating with the orifices when the second substrate is joined with the first substrate, and a leaf member spring for mechanically press joining the first and second substrates, in which the first and second substrates are press joined by line pressure produced by an end portion of a bent projection of the leaf spring member outer face of which is in contact with a surface of the front plate member, the surface facing an opposite direction to a direction in which ink is ejected.

In accordance with the structures as described above, in press joining the first substrate and the second substrate, the contact surface of the leaf spring member which contacts the second substrate (top plate) is made linear so as to produce concentrated joining force so that a region of the second substrate covering the ink passages in the vicinity of the orifices is preferred by substantially uniform pressure. With this arrangement, an relative vibration between the first substrate and the second substrate is caused by the ink ejection so that the second substrate oscilatorilly separates from the first substrate. As a result, gaps between the channel walls of the ink passes is formed so that bubbles are expelled through the gaps as described above.

FIG. 8 through FIG. 12 show an embodiment of the recording head with its structure described above and the ink jet recording apparatus using this recording head. In the following descriptions, each component structure of the ink jet recording head and the ink jet recording apparatus is explained with these drawings.

Figure 9:
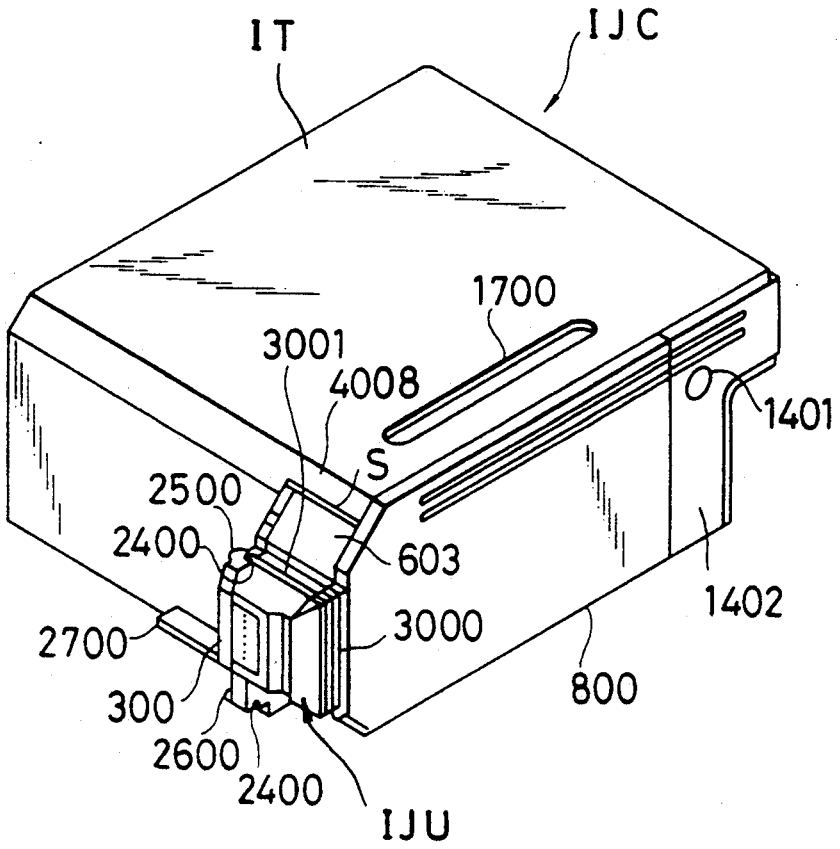
FIG. 9 is a perspective view showing the appearance of the recording head cartridge of FIG. 8.
Figure 11:
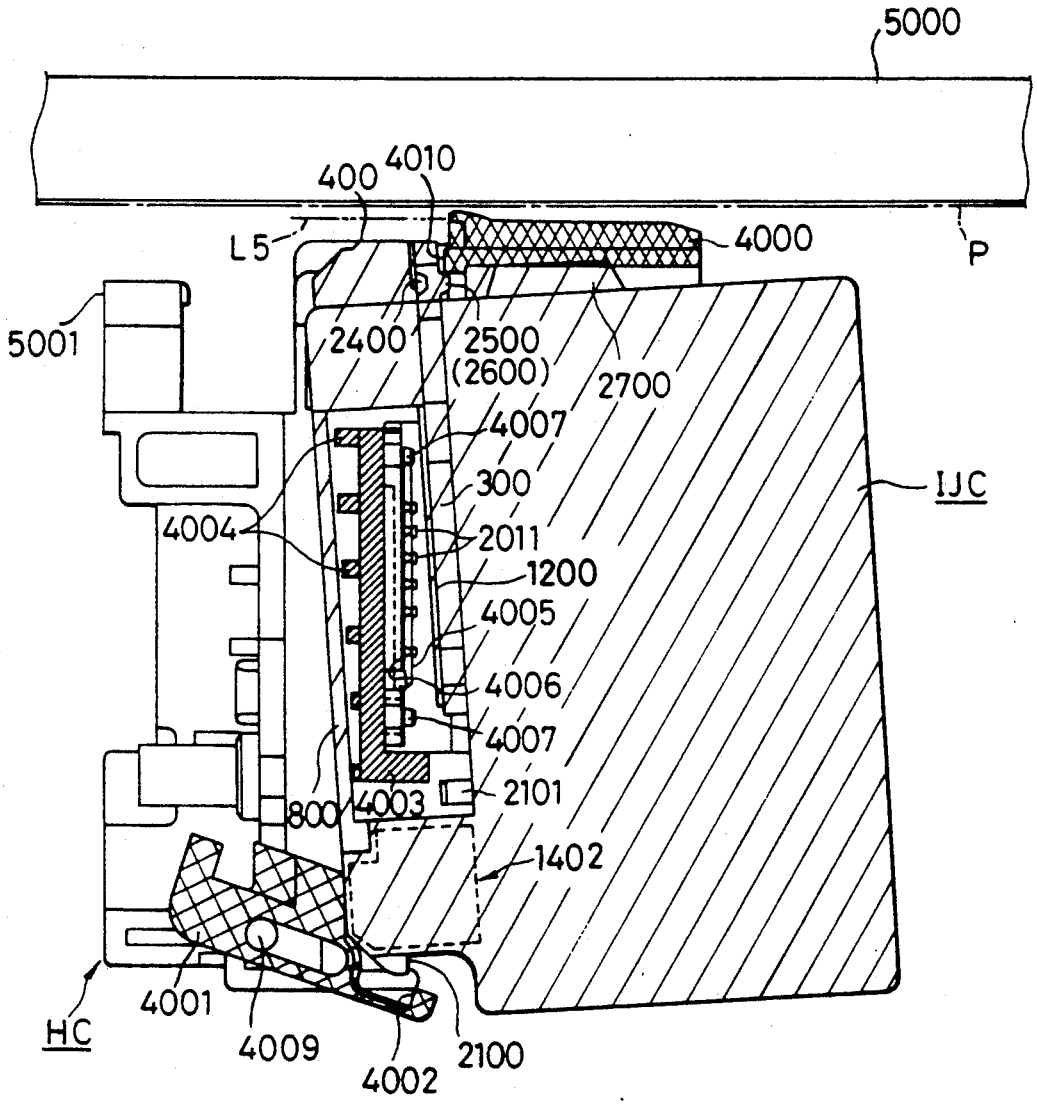
FIG. 11 is a plan view for explaining the mounting of the recording head cartridge on the apparatus.

The recording head carriage IJC in this embodiment, as shown in FIG. 9, has an ink tank IT which has a relatively large capacity for receiving ink and the recording head unit IJU integrally. The recording head unit IJU has such a shape that a top portion of the recording head unit IJU sticks out from the front face of the ink tank IT. This recording head cartridge IJC is fixed and supported by locating means and an electric contact member described later, of the carriage HC as shown in FIG. 11 which is provided with the ink jet recording system IJRA. In this arrangement, the recording head cartridge IJC can be exchanged when ink in the ink tank IT is spent completely. This means that the recording head unit IJU is also exchanged.

(i) The construction of the recording head unit IJU

The recording head unit IJU in this embodiment has a recording head using an ink ejection mechanism where in response to input electric signal, an electro-thermal converting element generates thermal energy to produce film boiling in the ink so that the ink ejection is carried out by the formation of a bubble caused by the film boiling.

Figure 8:
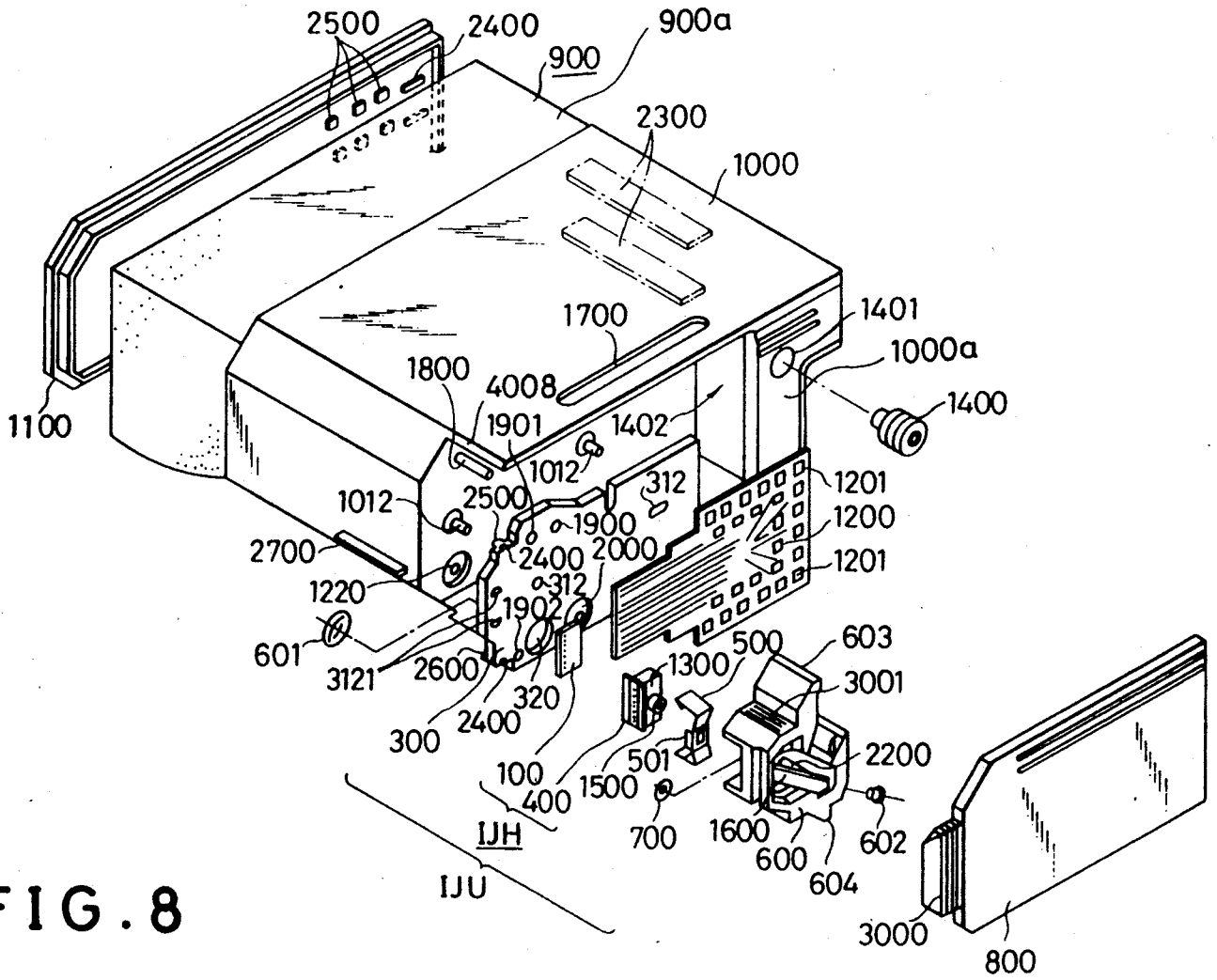
FIG. 8 is an exploded perspective view showing an arrangement of a recording head cartridge including a recording head to which the second embodiment of the present invention can be preferably applied.

In FIG. 8, reference numeral 100 denotes a heater board or substrate. The heater board 100 is composed of electro-thermal converting elements (ejection heaters) arranged in an array geometry on a silicon substrate plate and electric wiring supplying powers to the electro-thermal converting elements formed with a film forming technology. Reference numeral 1200 denotes a distribution substrate connecting to the heater board 100, containing wirings to the heater board 100 (both ends of the wirings, for example, are fixed by wire bonding) and pads 1201 locating at one end of the wiring from the heater board 100 for transferring electric signals from the host apparatus of the ink jet recording apparatus.

Reference numeral 1300 denotes a top plate with grooves which are provided for forming separation walls for defining individual ink passage, a common fluid reservoir and so on. In addition, the top plate 1300 is a molded unit with an ink inlet 1500 for pouring ink supplied from the ink tank IT into the common fluid reservoir and an orifice plate 400. Though the preferable material for the molded unit is polysulfone, another kind of molding resin may be acceptable to be used.

Reference numeral 300 denotes a support member, for example, made of metal, supporting the reverse side of the distributing substrate 1200 by meeting their flat faces together, defining a bottom of the recording head unit IJU. Reference numeral 500 denotes a leaf spring shaped like a letter M. The leaf spring 500 process a certain portion of the top plate 1300 which is corresponds to the fluid reservoir of the center of the letter M and at the same time its project portion 501 which projects at the side portion of the leaf spring 500 also presses a portion of the top plate 1300 which is corresponds to the ink passages. The press of the project portion 501 is such that the pressure force is concentrated on a line which is defined by the end of the project portion 501. Legs of the leaf spring 500 penetrate through the holes 3121 at the support member 300 and are fixed in the reverse side of the support member 300 so that the heater board 100 and the top plate 1300 are held between the leaf spring 500 and the support member 300 rebound force. That is, the heater board 100 and the top plate 1300 can be fixed and contacted to each other by the rebound force generated with the leaf spring 500 and its project portion 501.

The support member 300 has locating holes 312, 312, 1900 and 2000 into which two protruding portions 1012, 1012 for locating and protruding portions 1800, 1801 for locating and supporting by fusion are inserted respectively. These protruding portions 1012, 1012, 1800 and 1801 are formed on the side wall of the body of the ink tank IT. The support member 300, in its rear side, has also protruding portions 2500 and 2600 for locating the recording head cartridge IJC on the carriage HC in the ink jet recording apparatus IJRA. In addition, the support member 300 has a hole 320 through which an ink supply pipe 2200 as disclosed later for supply ink to a recording head IJC from the ink tank IT. The distributing substrate 1200 is bound on the support member 300 by bonding materials or the like. There are a couple of concave portions 2400, 2400 on the support member 300 in the neighborhood of the locating protruding portions 2500 and 2600. In the ink jet cartridge IJC as shown in FIG. 9, the concave portions 2400, 2400 are also located on the extension of the line from the apex portion of the recording head unit IJU, three sides of which are defined in portion having a plurality of parallel grooves 3000 and 3001. Therefore, the concave portions 2400, 2400 make it possible to keep unfavorable dust and ink sludge away from the protruding portions 2500 and 2600. On the other hand, as illustrated in FIG. 8, a cover plate 800 on which the parallel grooves 3000 are formed forms an outer wall of the recording head cartridge IJC and accommodates the recording head unit IJU. In an ink supply member 600 having other parallel grooves 3001 includes an ink pipe 1600 which is arranged as a cantilever with its fixed end being on the side of the ink supply pipe 2200 and is connected to the ink supply pipe 2200. A sealing pin 602 is inserted into the ink pipe 1600 in order to establish a capillary action between the fixed end of the ink pipe 1600 and the ink supply pipe 2200. A free end of the ink pipe 1600 is joined to the ink inlet 1500 with pressure force. Reference numeral 601 denotes a packing material for sealing a joint portion between the ink tank IT and the in supply pipe 2200. Reference numeral 700 denotes a filter placed at the end portion of the ink supply pipe 2200 on the side of the ink tank IT.

As the ink supply member 600 is made by a molding method, the supply member 600 is attained a low cost and is finished with correct dimensions in the molding process practically. Further, in the ink supply member 600, owing to the cantilever structure of the ink pipe 1600, it is possible to keep the stable state of pressure welding the ink pipe 1600 onto the ink inlet 1500 in mass production planning. In this embodiment, under the state of pressure welding the ink pipe 1600 onto the ink inlet 1500, only by pouring a sealing bond into the side of the ink inlet 1500 from the side of the ink supply member 600, it is possible to establish a perfect ink flow path without leakage. The method for fixing the ink supply member 600 to the support member 300 is described as in the following steps; (1) putting pins (not shown) at the rear side of the ink supply member 600 into holes 1901, 1902 at the support member 300 and push out the pins through the holes 1901, 1902 at the other face of the support member 300, and (2) bonding the end portion of the pins onto the rear face of the support member 300 by heat fusion method. The end projection of the pins bonded is held in a relevant concave portion (not shown in drawings) on the side surface of the ink tank IT where the recording head unit IJU is mounted, and then a location of the recording head unit IJU is fixed correctly with the ink tank IT.

(ii) The structure of the ink tank IT

The ink tank IT is composed of a body of cartridge 1000, an ink absorber 900 and a cover plate 1100. The cover plate 1100 is used as to seal the ink absorber 900 after inserting the ink absorber 900 into the body of cartridge 1000 from an opening on the opposite side of the face where the recording head unit IJU is mounted in the body of cartridge 1000.

The ink absorber 900 is used for absorbing ink and placed in the body of cartridge 1000. Reference numeral 1220 denotes an ink supply outlet for supplying ink to the recording head unit IJU comprising the above mentioned components 100 through 600. In addition, the outlet 1220 is also used as to be an inlet port for pouring ink into the absorber 900 by an ink pouring process prior to mounting the recording head unit IJU on the body of cartridge 1000.

In this embodiment, ink can be supplied into the ink tank IT through either an atmospheric air communication port 1401 or this ink supply outlet 1220. However, for the purpose of pouring ink into the absorber 900 relatively efficiently and uniformly, it is preferable to pour ink through the ink supply outlet 1220. This is because the empty space only containing air in the ink tank IT, which is formed by ribs 2300 in the body of cartridge 1000 and partial ribs 2400 and 2500 of the cover plate 1100 in order to attain an efficient ink supply flow from the absorber 900, occupies a corner space communicating with the atmospheric air communication port 1401 and positioning at a longest distant from the ink supply outlet 1220. The body of cartridge 1000 comprises four ribs 2300, 2300, 2300, 2300 (only two ribs are shown in FIG. 8) parallel to the moving line of the carriage HC. The ribs 2300, 2300, 2300, 2300 are arranged on the back end of the inner surface of the body of cartridge 1000 so that the rib 2300 prevents the absorber 900 from contacting to the back end of the inner surface of the body 1000 of the ink tank. The partial ribs 2400 and 2500 are also placed on the inner surface of the cover plate 1100 positioned on the extension line from the ribs 2300, 2300, 2300, 2300. In contrast with the rib 2300, the partial ribs 2400 and 2500 are composed of many smaller pieces of ribs respectively so that a volume of empty space containing air of the ribs 2400 and 2500 becomes larger than the ribs 2300, 2300, 2300, 2300. The partial ribs 2400 and 2500 are distributed over half or less of the area of the inner face of the cover plate 1100. With these ribs, the flow of ink from the corners of the ink tank IT far from the ink supply outlet 1220 to the ink supply outlet 1220 is stabilized, so that the ink can be lead from every region of the absorber 900 into the ink supply outlet 1220 by a capillary action. The atmospheric air communication port 1401 is an open hole on the cover plate for communicating air between the inner containment of the ink tank IT and the atmosphere. The atmospheric air communication port 1401 is plugged with an ink repellant material 1400 for preventing ink leakage.

A space of ink containment of the ink tank IT in this embodiment is a rectangular parallelepiped piped and a longer side of the space is corresponding to the side of the ink tank IT as shown in FIG. 8 and FIG. 9. Hence, the layout described above are effective specifically in this case. In case that the ink tank IT has its longer side in the direction of the movement of the carriage HC or the ink tank IT has the inner containment space in a cube, the flow of ink in the absorber 900 can be stabilized by placing those ribs on the whole area of the inner face of the cover plate 1100.

A rectangular ink reservoir (ink tank) is preferable to contain ink as much as possible in a limited space. With such ink reservoir, it is effective to provide ribs 2300, 2400 and 2500 that can achieve the above effect at two areas near the corners of the ink tank IT to use ink stored in the ink tank IT without waste. In addition, the ribs 2300, 2400, 2500 inside the ink tank IT of the present embodiment are nearly uniformly disposed in the thickness direction (the vertical direction in FIG. 8) of a rectangular ink absorber 900. This arrangement is important because the ribs form space between the ceiling plate (the cover plate 1100, the body of cartridge 1000) of the ink tank IT and the absorber 900, and the space enables atmospheric pressure to be applied uniformly on the ink retained in the absorber 900 so that the ink in the absorber 900 can be used up leaving a least amount of waste ink.

The technological conception of the positioning of the ribs will be more specifically described. The position of the ribs must be determined so that they are placed at the diagonal corner 900*a* of the absorber 900 with regard to the ink supply outlet 1220 because the ink in this corner is liable to remain there. In other words, the diagonal corner 900*a* exists out the circular arc with its center at the ink supply outlet 1220 and with radius of the length of longer side of the ink tank IT, and with such positioning of the ribs, atmospheric pressure rapidly applies on diagonal corner 900*a*. The atmospheric air communicating port 1401 is not restricted to the position of the embodiment as long as it can guide the air into the area at which the ribs are disposed.

In addition, in this embodiment, the rear surface of the recording head cartridge IJC is made plane so that the space required to mount the cartridge IJC on the apparatus is minimized, or the ink amount contained in maximized. As a result, the size of the apparatus is made smaller, and the exchange frequency of the cartridge IJC can be reduced.

Furthermore, projected portion 1000*a* for providing the atmospheric air communicating port 1401 is formed utilizing the back portion of the space for unifying the recording head unit IJU to the ink tank IT. Inside the projected portion 1000*a*, a hollow is formed in which a space 1402 for applying atmospheric pressure to the absorber 900 in the vertical direction is provided. The space 1402 for applying atmospheric pressure is a comparatively large space, in the upper side of which the atmospheric air communicating port 1401 is provided. This makes it possible to temporarily hold the leaked ink in the case where the ink accidentally leaks from the absorber 900, and to positively retrieve it into the absorber 900.

A structure of the mounting face of the ink tank IT to which the recording head unit IJU is mounted is illustrated in the FIG. 10. When a line L1 is taken to be a straight line passing through the center of the ink ejection outlet of the orifice plate 400 and parallel to the bottom face of the ink tank IT or to the reference face on the surface of the carriage HC, two protruding portions 1012, 1012 to be inserted into the hole 312 of the support member 300 are on the line L1. The height of the protruding portions 1012, 1012 is a little less than the thickness of the support member 300 and the support member 300 is positioned with the protruding portions 1012, 1012. On the extension of the line L1, as shown in FIG. 10, a click 2100 is formed for catching a right angular hook surface 4002 of a locating hook 4001 which is formed on the carriage HC as shown in FIG. 11, so that a force for locating the recording head cartridge IJC to the carriage HC is applied in parallel to the before mentioned reference face on the surface of the carriage HC including the line L1. This layout relationship forms an effective structure to make the accuracy of locating the recording head cartridge IJC to the carriage HC to be equivalent to that of locating the ink ejection outlet of the ink jet head IJH.

In addition, the length of the protruding portions 1800 and 1801 to be inserted in the holes 1900 and 2000 for fixing the support member 300 onto the side wall of the ink tank IT is greater than that of the above mentioned protruding portions 1012. The portions 1800 and 1801 are used for fixing the support member 300 on the side wall of the ink tank IT by penetrating through the holes 1900, 2000 of the support member 300 and by bonding the end part of the protruding portions 1800 and 1801 to the support member 300 with a heat fusion method. Let L3 be a straight line intersecting perpendicularly with the straight line L1 and passing the protruding portion 1800, and let L2 a straight line intersecting perpendicularly with the straight line L1 and passing the protruding portion 1801. The center of the before mentioned ink supply outlet 1220 is located nearly on the straight line L3 so that the protruding portion 1800 works for stabilizing the connection state between the ink supply outlet 1220 and the ink supply pipe 2200 so as to make it possible to reduce the over load on this connection state in case of dropping them and/or giving them shocks. As the straight lines L2 and L3 do not intersect at any point each other and there are protruding portions 1800 and 1801 in the neighborhood of the protruding portion 1012 at the side of the ink ejection outlet of the recording head IJH, a supportive effect occurs for locating the recording head unit IJU on the ink tank IT. And a curve L4 illustrated in FIG. 7 shows a position of an outside wall of the ink supply member 600 when installed. As the protruding portions 1800 and 1801 are disposed out along the curve L4, it is possible that the ink tank IT stably supports the recording head unit IJU with enough high strength and dimensional accuracy under the application of the weight load of the recording head unit IJU. When the recording head cartridge IJC is mounted on the carriage HC, a nose flange 2700 of the ink tank IT is inserted into a hole in a front plate 4000 of the carriage HC (shown in FIG. 11) so as to prevent an abnormal state where the displacement of the recording head cartridge IJC becomes extremely large.

Reference numeral 2101 designates a stop for preventing the cartridge IJC from slipping off the carriage HC, and is placed corresponding to a bar (not shown) of the carriage HC. With this arrangement, when the cartridge IJC is mounted by being turned on the carriage HC, the stop 2101 enters into a lower side of the bar so that the cartridge IJC maintains its position even if such an accidental upward force as separating the cartridge IJC from its normal mounting position acts on the cartridge IJC.

The recording head unit IJU is installed inside of the cartridge IJC and then is closed with the cover plate 800 so that the recording head unit IJU is surrounded by the cartridge IJC and the cover plate 800 except an underside of the cartridge IJC. However, this underside opening is close to a mounting surface of the carriage HC when the recording head cartridge IJC is mounted on the carriage HC, thereby a substantially perfectly closed space around the recording head unit IJU is established. Accordingly, though the heat generated from the recording head IJH within the closed space is valid as forming a heat jacket, during a long time of a continuous ink ejection, the temperature of the closed space increases slightly. In this embodiment, for promoting a natural heat dissipation from the supporting member 300, a slit 1700 with a width less than that of the above-mentioned closed space is formed on the upper deck of the recording head cartridge IJC as shown in FIGS. 8, 9 and 10. Owing to the slit 1700, it is possible to prevent the temperature rise within the closed space and to establish an uniform temperature distribution in the whole of the recording head unit IJU being independent of any environmental fluctuation.

By assembling the recording head cartridge IJC composed of the ink tank IT and the recording head unit IJU as shown in FIG. 9, ink can be fed from the ink tank IT into the ink supply member 600 thorough the ink outlet 1220, the hole 320 of the supporting member 300 and a inlet provided on a back face of the ink supply member 600, and after ink flows inside the ink supply member 600, ink pours into the common in chamber through an adequate ink supply tube and the ink inlet 1500 of the top plate 1300 from the ink outlet of the ink supply member 600. Gaps formed at connecting portions of these components for supplying ink described above are filled with packing substance such as a silicone rubber, a butyl rubber or the like for sealing the gaps, and then an ink feed route is established.

In this embodiment, a material used for the top plate 1300 is an ink-resistant synthetic resin such as polysulfone, polyether sulphone, polyphenylene oxide, polypropylene or the like. The top plate 1300 is molded into a single module together with the orifice plate 400.

As described above, as the ink supply member 600, the single module of the top plate 1300 with the orifice plate 400, and the body 1000 of the ink tank IT are a single module molded respectively, not only a high accuracy in assembling the components for ejecting ink can be attained but also a quality of the components in a mass production is increased effectively. In addition, by assembling individual parts into a single molded component, the number of parts of the recording head cartridge IJC may be reduced, compared with a conventional assembling method.

In this embodiment, a slit S (as shown in FIG. 9) and another slit (not shown) similar to the slit S are provided above the under the ink supply member 600: as shown in FIGS. 8–9, the slit S is formed between the top surface 603 of the ink supply member 600 and the front portion 4008 of the ceiling surface of the ink tank IT which is provided with a slit 1700; and the other slit is formed between the bottom surface 604 of the ink supply member 600 and a head side portion 4011 of a thin plate member to which a cover plate 800 of the ink tank IT is joined with adhesive bonding. These slits between the ink tank IT and the ink supply member 600 not only serve to enhance the heat dissipation from the slit 1700, but also prevent undue forces applied to the ink tank IT from directly acting on the supply member 600 or the recording head unit IJU.

(iii) An installation of the recording head cartridge IJC onto the carriage HC

In FIG. 11, reference numeral 5000 denotes a platen roller for guiding a recording medium P such as a sheet of paper moving in the direction from a back side of the drawing paper of FIG. 11 to a front side. The carriage HC moves along the platen roller 5000. The carriage HC has, in a forward area of the carriage HC facing to the platen roller 5000, the front plate 4000 (with a thickness of 2 mm) in front of the recording head carriage IJC and has, at the left said of the middle area in the carriage HC, a support board 4003 which is erected perpendicularly to the surface of the carriage HC. The support board 4003 supports a flexible sheet 4005 furnished with pads 2011 corresponding to pads 1201 on the distributing substrate 1200 of the recording head cartridge IJC, and a rubber pad 4006 for generating elastic force for pressing the reverse side of the flexible sheet 4005 onto the pads 2011. In addition, the carriage HC has the locating hook 4001 for holding the recording head cartridge IJC. The front plate 4000 has two locating protruding surfaces 4010, 4010 corresponding to the before mentioned locating protrusions 2500 and 2600 of the support member 300. The locating protruding surfaces 4010, 4010 receive a vertical pressure when the recording head cartridge IJC is installed in the carriage HC. The front plate 4000 has, on the side of the platen roller 5000, a plurality of reinforcing ribs (not shown in drawings) elongating in the direction opposing to the vertical pressure. The surface of these ribs is a little closer by about 0.1 mm to the platen roller 5000 than the position of front surface L5 (shown in FIG. 11) of the recording head cartridge IJC and hence these ribs are used also for protecting the recording head IJH from the recording medium or the like. The support board 4002 for electrical connection has a plurality of reinforcing ribs 4004 elongating in the vertical direction to the elongating direction of the above-mentioned reinforcing ribs of the front plate 4000. An amount of the protrusion of the ribs 4004 is gradually reduced along the direction from the platen roller 5000 side to the hook 4001. This configuration of the ribs 4004 also enables the recording head cartridge IJC to be positioned with an inclination angle to the plate roller 5000 as shown in FIG. 11. The support board 4003 applies force to the distributing substrate 1200 of the recording head cartridge IJC so as to stabilize electrical connection, that is, two locating surfaces 4007, 4007 are formed on the support board 4003. The locating surfaces 4007, 4007 between which a pad contact region is defined limit the distortion length of the rubber pad sheet 4006 corresponding to pad 2011. Once the recording head cartridge IJC is mounted in the right position, the locating surfaces 4007, 4007 contact on the surface of the distributing substrate 1200. Moreover, in this embodiment, as pads 1201 of the distributing substrate 1200 is arranged on symmetrical with respect to the before mentioned straight line L1 (shown in FIG. 10), the distortion amount of the pads on the rubber pad sheet 4006 is made to be uniform and then a contacting pressure between the pads 2011 and 1201 is more stabilized. In this embodiment, the pads 1201 are arranged in an array with 2 center rows, 2 upper columns and 2 under columns as shown in FIG. 8.

The locating hook 4001 has a slot engaging an fixing axis 4009 of carriage HC. Using a movable space defined in the slot, by rotating the locating hook 4001 counterclockwise from the position shown in the FIG. 11 and moving the locating hook 4001 left in a parallel line to the platen roller 5000, the location of the recording head cartridge IJC can be mounted on the carriage HC. Though any means for moving the locating hook 4001 may be used, a moving mechanism with a lever or the like is suitable for moving the locating hook 4001. The following is a further detailed and stepwise description about mounting the recording head cartridge IJC on the carriage HC. (1) At first, in response to the rotating movement of the locating hook 4001, the recording head cartridge IJC moves to the side of the platen roller 5000 and at the same time the locating protrusions 2500 and 2600 move to the position where they can contact the locating protruding surfaces 4010, 4010 of the front plate 4000. (2) Next, by the movement of the locating hook 4001 in the left direction, a rectangular surface of the hook surface 4002 well contacts a rectangular surface of the click 2100 of cartridge IJC and at the same time the locating hook 4001 rotates horizontally around the contacting of the locating components 2500 and 4010, and then as a result the pads 1201 and 2011 begin to contact closely to each other. (3) The locating hook 4001 is held in a fixed position, thereby a perfect contacting state between the pads 1201 and 2011, a perfect contacting state between the locating protrusions 2500 and 4010, a facial contacting state between the rectangular surface of the hook surface 4002 and the click 2100 and a face contacting state between the distributing substrate 1200 and the locating surfaces 4007, 4007 of the support board 4003 are established at the same time, and then the mounting of the recording head cartridge on the carriage HC is established finally.

(iv) The ink jet recording apparatus

Figure 12:
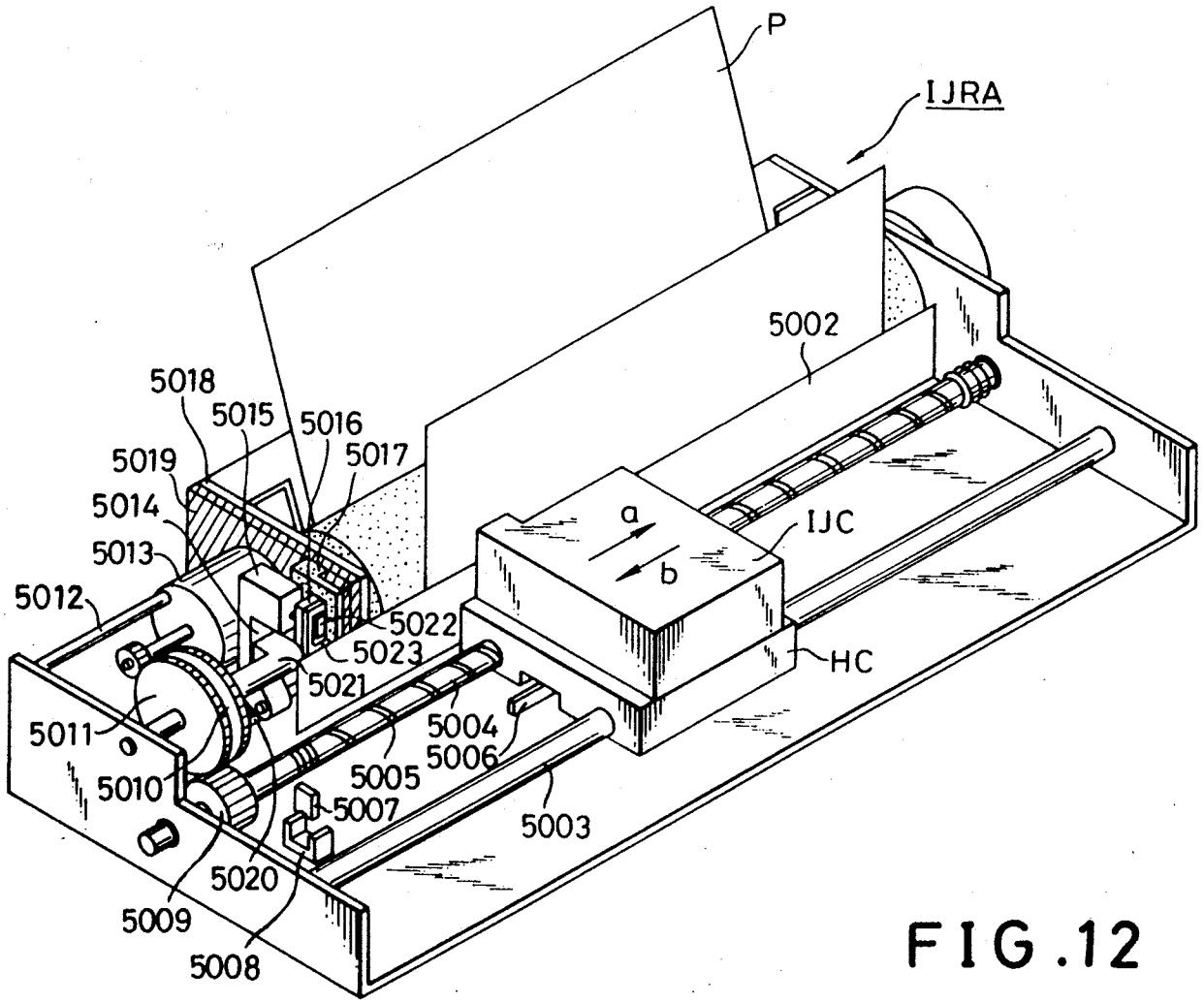
FIG. 12 is a schematic perspective view of an ink jet recording apparatus to which the recording head cartridge shown in FIG. 8 is applied.

FIG. 12 illustrates schematically perspective view of an ink jet recording apparatus IJRA using the recording head cartridge IJC described above. A lead screw 5004 is rotated reversibly by the torque transmitted through driving gears 5011, 5010 and 5009 from a driving motor 5013. As the driving motor 5013 rotates clockwise or counterclockwise, simultaneously the lead screw 5004 rotates in the same manner. A pin arranged in the carriage HC meshes with a lead groove 5005 so that the carriage HC moves in the either direction of the arrow a or b as shown in FIG. 12 as the lead screw 5004 rotates clockwise or counterclockwise. Reference numeral 5002 denotes a paper pressure plate. The paper pressure plate 5002 presses the recording medium P over a range along the moving direction of the carriage HC against the platen roller 5000. Reference numerals 5007 and 5008 denote photo-couplers, which generate a signal for sensing an existence of a lever 5006 in the region where photo-couplers are placed. The signal is used to change the turning direction of the motor 5013 at a home position and so on. Reference numeral 5016 denotes a supporting member for support a cap 5022 which is used to cap the front side of the recording head IJH. Reference numeral 5015 denotes a sucking makes an inside of the cap 5022 to be negative pressure so that the ink is absorbed from the ejection outlets of the recording head, that is, the sucking unit 5015 absorbs ink through an aperture 5023 within the cap 5022. Reference numeral 5017 denotes a cleaning blade. Reference numeral 5019 denotes a member for enabling the cleaning blade 5017 to move forward or backward. The cleaning blade 5017 and the member 5019 are supported by a supporting plate 5018. As for another embodiment of the cleaning blade 5017, need less to say another other types of cleaning blades as used in the prior art, are applicable to the present embodiment. In addition, a lever 5021 used for starting an absorbing procedures by the sucking unit 5015. The lever 5021 moves in accordance with the movement of a cam 5020 which can engages the carriage HC so that a driving force from the driving motor 5013 is transmitted to the sucking unit 5015 through transmission mechanism as used in prior art such as means for switching a clutch. These capping, cleaning and absorption restoration operations are respectively performed in accordance with the movement of the carriage HC to the home position, that is, the operations are performed at their right positions in accordance with the rotation of the lead screw 5004. However, so long as an arrangement for the above mentioned operations is that the operations are performed at an appropriate timing, such arrangement may be applied to the apparatus of this embodiment.

Incidentally, the leaf spring 500 (shown in FIG. 8) is used to mechanically press join the substrate (heater board) 100 and the top plate 1300 to form the ink passages and the common liquid chamber as described above, and is made, for example, from phosphor bronze, stainless steel for springs, FRP, or the like. Adhesives are used for temporarily fixing the substrate 100 and the top plate 1300 with grooves: in practice, a photo-setting type adhesive is used.

The leaf spring 500 has an M-shaped form which has a spring portion (vertical portion in FIG. 8) near parallel with the top surface of the top plate 1300, and side portions along the sides of the substrate 100 and the top plate 1300. The side portions have nails at the ends thereof that engage the supporting plate 300 to produce pressure of the leaf spring 500. In addition, the plate spring 500 has a projection 501 that protrudes at the side of spring portion thereof, and is turned perpendicularly to that portion toward the top of the top plate 1300. The projection 501 press joins the substrate 100 and the top plate 1300 by means of line pressure so as to concentrate the stress produced by the leaf spring 500, thereby obtaining uniform pressure applied to the substrate and the top plate.

Although it is preferable that the joining member like the leaf spring 500 is provided with members like the projection 501, the projection 501 is not essential to achieve the bubble moving effect through the gaps between the adjacent ink passages. Such a leak spring provides uniform joint force on the vicinity of ejection outlets and on the entire areas of the ink passages at which reliable joint is required because the leaf spring presses the top plate downward and the pressure is distributed. On the other hand, the leaf spring presents only weak joint force on the peripheries of the ink passages. Thus, the leaf spring is suitable for producing the above-mentioned gaps in the channel walls separating the ink passages.

As a material of the flat spring 500, the present embodiment uses phosphor bronze, thereby producing force of 1 kg with thickness of 0.15 mm. The projection 501 functioning as line pressure generating portion is provided on the leaf spring 500. With this arrangement, the pressure can be uniformly applied to the areas where ink passages are formed and to the vicinity of the ejection outlets along the entire region in which the ejection outlets are disposed. Thus, the channel walls between the adjacent ink passages are positively formed. This will increase the relative pressure difference along the extending direction of the ink passages, and hence the oscillation of the top plate or the like caused by the pressure waves in the ink associated with the ink ejection can be concentrated at the region from the back of the electro-thermal converting elements to the common liquid chamber. As a result, increasing effect can be achieved to remove bubbles sticking to the inner walls, and to remove bubbles via the gaps.

Incidentally, as describe above, the ejection recovery procedures of the foregoing embodiment of the present invention are effective for recording heads having the common liquid chamber and the plurality of ink passages communicating thereto. The arrangement of the ink passages with regard to the common liquid chamber is not restricted to the manner described above. For example, a multiple layer arrangement of ink passages can be adopted wherein passages, and all the ink passages communicate to the common ink chamber. In this case, bubbles in the ink passages can be expelled by ejecting ink from the surrounding ink passages, namely, from top, bottom, left hand right hand ink passages of that ink passage.

Furthermore, the ejecting ink can be directed in any direction: it can face upward, downward, sideward, or any other directions.

Furthermore, in the foregoing embodiments, expelling procedure of remaining bubbles in the recording head is described exemplifying the recording head in which ink is ejected by the bubble generated in the ink by thermal energy. The present invention, however, can be applied to recording heads adopting ejection system which uses ejection energy elements such as piezoelectric elements for producing pressure waves in the ink.

Further, this specification discloses that the bubble expelling procedures where the ink ejection is carried out from the orifices connected to the ink passages which include at least the ink passage adjacent to the ink passage that contains a bubble to be expelled, but which exclude the ink passage that contains the bubble to be expelled so that pressure fluctuations in ink or ink flows occur to thereby expel the bubble. Therefore, it is not necessary that the recording head in which the bubble expelling procedures described above can be carried out has the structure described above.

As is clear from the above description, the present invention is characterized in that it does not eject ink from the very orifices from which the remaining bubbles are to be expelled, but ejects ink from other orifices at least including orifices adjacent to those orifices from which the remaining bubbles are to be expelled in the case where bubbles remaining in the ink passages are expelled in the recording head. Thus, the remaining bubbles are expelled from the aimed orifices. In this point, the present invention differs from the conventional ejection recovery procedure which is known as an idle ejection. An example of the conventional ejection recovery method is disclosed in Japanese Patent Application Laying-open No. 2-194967. With this method, comparatively small remaining bubbles, or ink of increased viscosity is discharged by ejecting ink from the orifice from which the small remaining bubbles or the ink of increased viscosity are to be expelled. It is difficult for the idle ejection, however, to expel remaining bubbles that have grown to comparatively large sizes.

The present invention is particularly suitably useable in an ink jet recording head having thermal energy means for producing thermal energy as energy used for ink ejection such as a plurality of electro-thermal transducers, a laser apparatus for generating a plurality of laser beams or the like and a recording apparatus using the head. The thermal energies cause variation of ink condition thereby eject ink. This is because a high density of the picture element and a high resolution of the recording are possible.

The typical structure and the operational principle are preferably the one disclosed in U.S. Pat. Nos. 4,723,129 and 4,740,796. The principle is applicable to a so-called on-demand type recording system; and a continuous type recording system particularly, however, it is suitable for the on-demand type because the principle is such that at least one driving signal is applied to an electro-thermal transducer disposed on liquid (ink) retaining sheet or ink passage, the driving signal being enough to provide such a quick temperature rise beyond a departure from nucleation boiling point, by which the thermal energy is provide by the electro-thermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electro-thermal transducer as disclosed in the above-mentioned patents. In addition, the present invention is applicable to the structure disclosed in Japanese laid-open Patent Application No. 123670/1984 wherein a common slit is used as the ejection outlet for plurality electro-thermal transducers, and to the structure disclosed in Japanese Patent Application Laying-open No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electro-thermal transducer or by a combination of the ejection electro-thermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording color or density may be equipped. The present invention is effectively applicable to an apparatus having at least one of a monochromatic mode solely with main color such as black and a multi-color mode with different color ink materials or a full-color mode by color mixture. The multi-color or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such as ink material as is liquefied by the application of the thermal energy. Such an ink material may be retained as a liquid or solid material on through holes or recesses formed in a porous sheet as disclosed in Japanese laid-open Patent Application No. 56847/1979 and Japanese laid-open Patent Application No. 71260/1985. The sheet is faced to the electro-thermal transducers. The most effective one for the ink materials described above is the film boiling system.

The ink jet recording apparatus may be used as an output means of various types of information processing apparatus such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatus requires means for outputting processed information in the form of hand copy.

Figure 13:
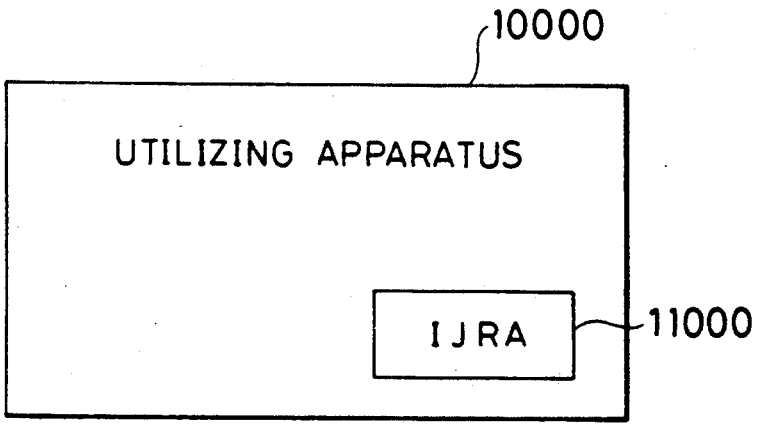
FIG. 13 is a schematic diagram illustrating an embodiment of an apparatus to which the ink jet recording apparatus in accordance with the present invention is equipped.

FIG. 13 schematically illustrates one embodiment of a utilizing apparatus in accordance with the present invention to which the ink jet recording apparatuses shown in FIG. 3, 6 and 12 are equipped as an output means for outputting processed information.

In FIG. 13, reference numeral 1000 schematically denotes a utilizing apparatus which can be a work station, a personal or host computer, a word processor, a copying machine, a facsimile machine or an optical disc apparatus. Reference numeral 11000 denotes the ink jet recording apparatuses (IJRA) shown in FIGS. 3, 6 and 12. The ink jet recording apparatuses (IJRA) 11000 received processed information from the utilizing apparatus 10000 and provides a print output as hand copy under the control of the utilizing apparatus 10000.

Figure 14:
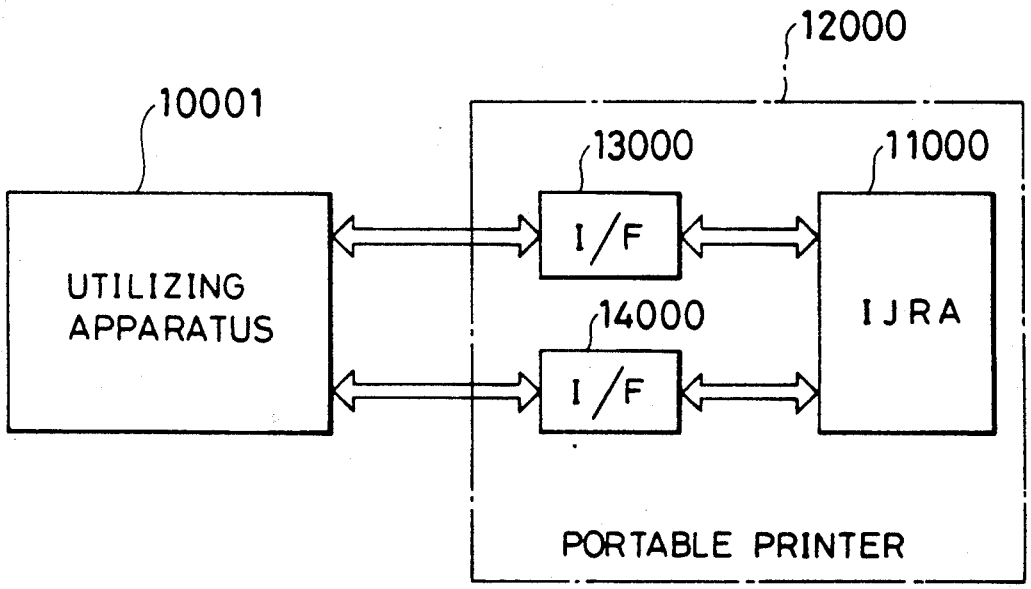
FIG. 14 is a schematic diagram illustrating an embodiment of a portable printer in accordance with the present invention.

FIG. 14 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 14, reference numeral 10001 schematically denotes such a utilizing apparatus. Reference numeral 12000 schematically denotes a portable printer having the ink jet recording apparatuses (IJRA) 11000 shown in FIGS. 3, 6 and 12 are incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

Although specific embodiments of a record apparatus constructed in accordance with the present invention have been disclosed, it is not intended that the invention be restricted to either the specific configurations or the uses disclosed herein. Modifications may be made in a manner obvious to those skilled in the art.

For example, although the embodiments are described with regard to a serial printer, the present invention can also be applied to line printers. Here, the serial printer is defined as a printer that has a moving member on which the record head is mounted, the moving member being moved to and from in the direction perpendicular to the transporting direction of the recording paper. Accordingly, it is intended that the invention be limited only by the scope of the appended claims.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A method for performing an ink ejection recovery at each of a plurality of orifices of a recording head in an ink jet recording apparatus, said recording head comprising a plurality of ejection energy generating elements each of which corresponds to each of said plurality of orifices, wherein said ink jet recording apparatus performs recording by ejecting ink from said plurality of orifices onto a recording medium, the method comprising the steps of:

selecting a particular orifice, at which ink ejection recovery is to be performed, from said plurality of orifices;

selecting ejection orifices, including at least one orifice adjacent to said particular orifice, from the rest of said plurality of orifices; and driving said ejection energy generating elements corresponding to said ejection orifices so as to eject ink from said ejection orifices, whereby ink ejection recovery at said particular orifice is performed.

2. A method for performing an ink ejection recovery at each of a plurality of orifices of a recording head in an ink jet recording apparatus, said recording head comprising a plurality of ink passages each of which correspondly communicates with each of said plurality of orifices and is provided with an ejection energy generating element, and a common liquid reservoir communicating with each of said plurality of ink passages, wherein said ink jet recording apparatus performs recording by ejecting ink from said plurality of orifices onto a recording medium, the method comprising the steps of:

selecting a particular orifice, at which ink ejection recovery is to be performed, from said plurality of orifice;

selecting ejection orifices, including at least one orifice adjacent to said particular orifice, from the rest of said plurality of orifices; and driving said ejection energy generating elements corresponding to said ejection orifices continuously a predetermined number of times so as to eject ink from said ejection orifices, whereby ink ejection recovery at said particular orifice is performed, 3. A method as claimed in claim 2, wherein ink is ejected from said particular orifice after ink is ejected from said ejection orifices.

4. A method as claimed in claim 2, wherein ink is ejected simultaneously from said ejection orifices.

5. A method as claimed in claim 2, wherein ink ejection recovery is performed at all of said plurality of orifices by alternately driving said ejection energy generating elements corresponding to odd numbered said orifices as said ejection orifices and driving said ejection energy generating elements corresponding to even numbered said orifices as said ejection orifices in an arrangement of said plurality of orifices.

6. A method as claimed in claim 2, wherein ink ejection recovery is performed at all of said plurality of orifices by sequentially driving said ejection energy generating elements corresponding to said plurality of orifices as ejection orifices in an arrangement of said plurality of orifices.

7. A method as claimed in claim 2, wherein each of said ejection energy generating elements corresponding to said ejecting orifices is driven continuously at a frequency lower than that at the time of performing a recording operation.

8. A method as claimed in claim 7, wherein said frequency can be determined in accordance with a state of a bubble remaining in said ink passage corresponding to said particular orifice.

9. A method as claimed in claim 2, wherein each said ejection energy generating element is an electro-thermal converting element to which one or a plurality of pulses are applied to generate thermal energy as ejection energy.

10. A method as claimed in claim 2, wherein said ejection energy generating elements of said ejection orifices are driven so as to eject ink from said ejection orifices to expel a bubble together with ink from said particular orifice.

11. A method for performing an ink ejection recovery at each of a plurality of orifices of a recording head in an ink jet recording apparatus, said recording head comprising a plurality of ink passages each of which correspondingly communicates with each of said plurality of orifices and is provided with an ejection energy generating element, a first substrate and a second substrate for forming said plurality of ink passages by joining main second substrate to said first substrate, and a joining member for press joining said first substrate and second substrate by applying line pressure to at least one of said first substrate and said second substrate, the method comprising the steps of:

selecting a particular orifice, at which ink ejection recovery is to be performed, from said plurality of orifices;

selecting ejection orifices, including at least one orifices adjacent to said particular orifice, from the rest of said plurality of orifices; and driving said ejection energy generating elements of said ejection orifices continuously a predetermined number of times so as to eject ink from said ejection orifices, whereby said ink ejection recovery at said aimed orifice is performed.

12. A method as claimed in claim 11, wherein ink is ejected simultaneously from said electrode orifices.

13. A method as claimed in claim 11, wherein ink ejection recovery is performed at all of said plurality of orifices by alternately driving said ejection energy generating elements corresponding to odd numbered said orifices as said ejection orifices and driving said ejection energy generating elements corresponding to even numbered said orifices as said ejection orifices in an arrangement of said plurality of orifices.

14. A method as claimed in claim 11, wherein ink ejection recovery is performed at all of said plurality of orifices by sequentially driving said ejection energy generating elements of said plurality of orifices as said ejection orifices in an arrangement of said plurality of orifices.

15. A method as claimed in claim 11, wherein each of said ejection energy generating elements corresponding to said ejection orifices is driven continuously at a frequency lower than that at the time of performing a recording operation.

16. A method as claimed in claim 15, wherein said frequency can be determined in accordance with a state of a bubble remaining in said ink passage corresponding to said particular orifice.

17. A method as claimed in claim 11, wherein each said ejection energy generating element is an electrothermal converting element to which one or a plurality of pulses are applied to generate thermal energy as ejection energy.

18. An ink jet recording apparatus for performing recording by ejecting ink onto a recording medium, the apparatus comprising:

a recording head having a plurality of orifices and a plurality of ejection energy generating elements each of which corresponds to each of said plurality of orifices;

selecting means for selecting a particular orifice, at which ink ejection recovery is to be performed, from said plurality of orifices and for selecting ejection orifices, including at least one orifices adjacent to said particular orifice, from the rest of said plurality of orifices; and driving means for driving said ejection energy generating elements corresponding to said ejection orifices so as to eject ink from said ejection orifices, whereby ink ejection recovery at said particular orifice is performed.

19. An ink jet recording apparatus for performing recording by ejecting ink onto a recording medium, comprising:

a recording head having a plurality of orifices, a plurality of ink passages each of which correspondingly communicates with each of said plurality of orifices and is provided with an ejection energy generating element, and a common liquid reservoir communicating with each of said plurality of ink passages;

selecting means for selecting a particular orifice, at which ink ejection recovery is to be performed, from said plurality of orifices and for selecting ejection orifices, including at least one orifice adjacent to said particular orifice, from the rest of said plurality of orifices; and driving means for driving said ejection energy generating elements corresponding to said ejection orifices continuously a predetermined number of times so as to eject ink from said ejection orifices, whereby ink ejection recovery at said particular orifice is performed.

20. An apparatus as claimed in claim 19, wherein ink is ejected from said particular orifice after ink is ejected from said ejection orifices.

21. An apparatus as claimed in claim 19, wherein ink is ejected simultaneously from said ejection orifices.

22. An apparatus as claimed in claim 19, wherein ink ejection recovery is performed at all of said plurality of orifices by alternately driving said ejection energy generating elements corresponding to odd numbered said orifices as said ejection orifices and driving said ejection energy generating elements corresponding to even numbered said orifices as said ejection orifices in an arrangement of said plurality of orifices.

23. An apparatus as claimed in claim 19, wherein ink ejection recovery is performed at all of said plurality of orifices by sequentially driving said ejection energy generating elements corresponding to said plurality of orifices as said ejection orifices in an arrangement of said plurality of orifices.

24. An apparatus as claimed in claim 19, wherein each of said ejection energy generating elements corresponding to said ejection orifices is driven continuously at a frequency lower than that at the time of performing a recording operation.

25. An apparatus as claimed in claim 24, wherein said frequency can be determined in accordance with a state of a bubble remaining in said ink passage corresponding to said particular orifice.

26. A method as claimed in claim 19, wherein each said ejection energy generating element is an electrothermal converting element to which one or a plurality of pulses are applied to generate thermal energy as ejection energy.

27. An ink jet recording apparatus as claimed in claim 19, wherein said ejection energy generating elements of said ejection orifices are driven so as to eject ink from said ejection orifices to expel a bubble together with ink from said particular orifice.

28. An ink jet recording apparatus for performing recording by ejecting ink onto a recording medium, the apparatus comprising:

a recording head having a plurality of orifices, a plurality of ink passages each of which correspondingly communicates with each of said plurality of orifices and is provided with an ejection energy generating element, a first substrate and a second substrate for forming said plurality of ink passages by joining said second substrate to said first substrate, and a joining member for press joining said first substrate and said second substrate by applying line pressure to at least one of said first substrate and said second substrate;

selecting means for selecting a particular orifice, at which ink ejection recovery is to be performed, from said plurality of orifices and for selecting ejection orifices, including at least one orifice adjacent to said particular orifice, from the rest of said plurality of orifices; and driving means for driving said ejection energy generating elements corresponding to said ejection orifices continuously a predetermined number of times so as to eject ink from said ejection orifices, whereby said ink ejection recovery at said particular orifice is performed.

29. An apparatus as claimed 27, wherein ink is ejected simultaneously from said ejection orifices.

30. An apparatus as claimed in claim 27, wherein ink ejection recovery is performed at all of said plurality of orifices by alternately driving said ejection energy generating elements corresponding to odd numbered orifices as said ejection orifices and driving said ejection energy generating elements corresponding to even numbered orifices as said election orifices in an arrangement of said plurality of orifices.

31. An apparatus as claimed in claim 28, wherein ink ejection recovery is performed at all of said plurality of orifices by sequentially driving said ejection energy generating elements of said plurality of orifices as said ejection orifices in an arrangement of said plurality of orifices.

32. An apparatus as claimed in claim 28, wherein each of said ejection energy generating elements corresponding to said ejection orifices is driven continuously at a frequency lower than that at the time of performing a recording operation.

33. An apparatus as claimed in claim 32, wherein said frequency can be determined in accordance with a state of a bubble remaining in said ink passage corresponding to said particular orifice.

34. A method as claimed in claim 28, wherein each said ejection energy generating element is an electrothermal converting element to which one or a plurality of pulses are applied to generate thermal energy as ejection energy.

35. An ink jet recording apparatus for performing recording by ejecting ink onto a recording medium, the apparatus comprising:

a recording head having a plurality of orifices, a plurality of ink passages each of which correspondingly communicates with each of said plurality of orifices and in each of which an ejection energy generating element is disposed;

a first substrate having a plurality of said ejection energy generating elements;

a second substrate having recesses and projections for forming said plurality of ink passages by joining said second substrate to said first substrate;

a leaf spring member for press joining said first substrate and said second substrate by application of line pressure produced by an end portion of a bent projection of said leaf spring member;

selecting means for selecting a particular orifice, at which ink ejection recovery is to be performed, from said plurality of orifices and for selecting ejection orifices, including at least one orifice adjacent to said particular orifice, from the rest of said plurality of orifices; and driving means for driving said ejection energy generating elements corresponding to said ejection orifices continuously a predetermined number of times so as to eject ink from said ejection orifices, whereby said ink ejection recovery at said particular orifice is performed.

36. An ink jet recording apparatus for performing recording by ejecting ink onto a recording medium, the apparatus comprising:

a recording head having a plurality of orifices, a plurality of ink passages each of which correspondingly communicates with each of said plurality of orifices and in each of which an ejection energy generating element is disposed;

a first substrate having a plurality of said ejection energy generating elements;

a second substrate integrally having an orifice plate having said plurality of orifice, a front plate member being formed integral to said orifice plate and having a portion projecting outwardly, and recesses and projections for forming said plurality of ink passages by joining said second substrate to said first substrate;

a leaf spring member for press joining said first substrate and said second substrate by application of line pressure produced by an end portion of a bent projection of said leaf spring member, wherein an outer face of said bent projection is in contact with a surface of said front plate member, said surface facing an opposite direction to a direction in which ink is ejected;

selecting means for selecting a particular orifice, at which ink ejection recovery is to be performed, from said plurality of orifices and for selecting election orifices, including at least one orifice adjacent to said particular orifice, from the rest of said plurality of orifices; and driving means for driving said ejection energy generating elements corresponding to said ejection orifices continuously a predetermined number of times so as to eject ink from said ejection orifices, whereby said ink ejection recovery at said aimed orifice is performed.

* * * * *

UNITED STATES PATENT AND TRADEMARK OFFICE

CERTIFICATE OF CORRECTION

PATENT NO. : 5,185,615

DATED : February 9, 1993

INVENTOR(S) : NORIBUMI KOITABASHI, ET AL.

It is certified that error appears in the above-identified patent and that said Letters Patent is hereby corrected as shown below:

On the title page:

IN [56] REFERENCES CITED

Under FOREIGN PATENT DOCUMENTS: "194967 1/1990 Japan ." should read --2-194967 8/1990 Japan .--.

Under Attorney, Agent, or Firm: "2-192954 7/1990 Japan ." should be deleted and reinserted under "FOREIGN PATENT DOCUMENTS".

COLUMN 1

Line 19, "invalve" should read --involve--.
Line 39, "as" should read --an--.
Line 62, "effect" should read --affect--.
Line 68, "effecting on" should read --affect--.

COLUMN 3

Line 3, "makes" should be deleted.
Line 41, "leak" should read --leaf--.
Line 42, "springs," should read --spring,--.
Line 58, "wrapped" should read --warped--.

COLUMN 4

Line 23, "expelled but" should read --expelled,--.
Line 24 should be deleted.
Line 25, "expelled," should be deleted.
Line 40, "orifice" should read --orifices--.

--

UNITED STATES PATENT AND TRADEMARK OFFICE

CERTIFICATE OF CORRECTION

PATENT NO. : 5,185,615

DATED : February 9, 1993

INVENTOR(S) : NORIBUMI KOITABASHI, ET AL.

It is certified that error appears in the above-identified patent and that said Letters Patent is hereby corrected as shown below:

COLUMN 6

Line 4, "a" should read --an--.
Line 37, "the" should read --The--.

COLUMN 7

Line 30, "rise" should read --rises--.

COLUMN 8

Line 1, "are" should read --is--.
Line 27, "ink pressure" should read --ink passages--.

COLUMN 10

Line 41, "procedures." should read --procedure.--.
Line 53, "new on" should read --a new one--.

COLUMN 11

Line 42, "procedure" should read --produced--.
Line 59, "$Nk_{-1}$ or $Nk_{+1}$" should read --$N_{k-1}$ or $N_{k+1}$--.

COLUMN 12

Line 3, "$Nk_{-1}$" should read --$N_{k-1}$--.
Line 46, "outlet" should read --outlets--.
Line 61, "staying" should read --remaining--.

--

UNITED STATES PATENT AND TRADEMARK OFFICE

CERTIFICATE OF CORRECTION

PATENT NO. : 5,185,615

DATED : February 9, 1993

INVENTOR(S) : NORIBUMI KOITABASHI, ET AL.

It is certified that error appears in the above-identified patent and that said Letters Patent is hereby corrected as shown below:

COLUMN 13

Line 4, "therein." should read --thereon.--.
Line 63, "preferred" should read --pressed--.
Line 67, "oscilatorilly" should read --oscillatorially--.

COLUMN 14

Line 1, "passes" should read --passages--.
Line 59, "process" should read --presses--.
Line 60, "is" should be deleted.
Line 64, "is" should be deleted.

COLUMN 15

Line 20, "for supply" should read --supplies--.
Line 48, "in" should read --ink--.

COLUMN 17

Line 2, "piped" should be deleted.
Line 46, "in" should read --is--.

COLUMN 18

Line 32, "L2 a" should read --L2 be a--.

COLUMN 19

Line 29, "thorough" should read --through--.
Line 33, "in" should read --ink--.
Line 59, "the under" should read --and under--.

UNITED STATES PATENT AND TRADEMARK OFFICE

CERTIFICATE OF CORRECTION

PATENT NO. : 5,185,615

DATED : February 9, 1993

INVENTOR(S) : NORIBUMI KOITABASHI, ET AL.

It is certified that error appears in the above-identified patent and that said Letters Patent is hereby corrected as shown below:

COLUMN 21

Line 47, "the either" should read --either the--.
Line 59, "support" should read --supporting--.

COLUMN 22

Line 3, "another" should be deleted.
Line 6, "used" should read --is used-- and "procedures" should read --procedure--.
Line 8, "can" should read --cam--.
Line 37, "plate" should read --leaf--.
Line 50, "leak" should read --leaf--.

COLUMN 23

Line 19, "wherein passages," should read --wherein each layer comprising a predetermined number of ink passages,--.
Line 23, "hand right" should read --hand and right--.

COLUMN 24

Line 8, "eject" should read --ejecting--.
Line 22, "provide" should read --provided--.

COLUMN 25

Line 42, "as ink" should read --an ink--.
Line 65, "1000" should read --10000--.

UNITED STATES PATENT AND TRADEMARK OFFICE

CERTIFICATE OF CORRECTION

PATENT NO. : 5,185,615

DATED : February 9, 1993

INVENTOR(S) : NORIBUMI KOITABASHI, ET AL.

It is certified that error appears in the above-identified patent and that said Letters Patent is hereby corrected as shown below:

COLUMN 26

Line 5, "received" should read --receive--.
Line 46, "invention," should read --intention,--.

COLUMN 27

Line 7, "correspondly" should read --correspondingly--.
Line 17, "orifice;" should read --orifices;--.
Line 47, "ejecting" should read --ejection--.

COLUMN 28

Line 4, "main" should read --said--.
Line 13, "fices" should read --fice--.
Line 21, "electrode" should read --ejection--.
Line 61, "one orifices" should read --one orifice--.

COLUMN 29

Line 51, "A method" should read --An apparatus--.

COLUMN 30

Line 19, "claimed 27," should read --claimed in claim 28,--.
Line 21, "claim 27," should read --claim 28,--.
Line 27, "election" should read --ejection--.
Line 44, "A method" should read --An apparatus--.

COLUMN 31

Line 21, "orifice," should read --orifices,--.

UNITED STATES PATENT AND TRADEMARK OFFICE

CERTIFICATE OF CORRECTION

PATENT NO. : 5,185,615

DATED : February 9, 1993

INVENTOR(S) : NORIBUMI KOITABASHI, ET AL.

It is certified that error appears in the above-identified patent and that said Letters Patent is hereby corrected as shown below:

COLUMN 32

Line 14, "election" should read --ejection--.

Signed and Sealed this

Twenty-second Day of February, 1994

Attest:

Bruce Lehman

BRUCE LEHMAN

Attesting Officer

Commissioner of Patents and Trademarks